US010557309B2

(12) United States Patent
Morissette et al.

(10) Patent No.: US 10,557,309 B2
(45) Date of Patent: Feb. 11, 2020

(54) SELF-SUPPORTING PNEUMATIC HAMMER POSITIONER WITH UNIVERSAL JOINT

(71) Applicant: R.N.P. INDUSTRIES INC., Boisbriand (CA)

(72) Inventors: Danny Morissette, Boisbriand (CA); Erick Smith, Blainville (CA); Luc Guimond, Val d'Or (CA); Ghislain Blanchet, Québec (CA); Guillaume Julien, Val d'Or (CA); Guy Tremblay, Rouyn-Noranda (CA); Réjean Lalonde, Val-d'Or (CA); Jean-Pierre Magny, Val d'Or (CA); Anthony Laroche, Val d'Or (CA); Youssef Chrourou, Quebec (CA); Alain Julien, Val d'Or (CA); Steve Laliberte, Val d'Or (CA); Raphael Paquin, Val d'Or (CA); Maxime Simard, Val d'Or (CA); Claude Trudel, Rivière-Héva (CA); Martin Menard, Val d'Or (CA); Tommy Manseau, Val d'Or (CA)

(73) Assignee: R.N.P. INDUSTRIES INC., Boisbriand, Quebec (CA)

( * ) Notice: Subject to any disclaimer, the term of this patent is extended or adjusted under 35 U.S.C. 154(b) by 366 days.

(21) Appl. No.: 15/504,705

(22) PCT Filed: Aug. 17, 2015

(86) PCT No.: PCT/CA2015/000464

§ 371 (c)(1),
(2) Date: Feb. 17, 2017

(87) PCT Pub. No.: WO2016/026022

PCT Pub. Date: Feb. 25, 2016

(65) Prior Publication Data

US 2017/0275947 A1 Sep. 28, 2017

Related U.S. Application Data

(60) Provisional application No. 62/038,463, filed on Aug. 18, 2014.

(51) Int. Cl.
*E21B 7/02* (2006.01)
*E21B 1/02* (2006.01)
(Continued)

(52) U.S. Cl.
CPC ..... *E21B 7/025* (2013.01); *B25D 17/28* (2013.01); *E21B 1/02* (2013.01); *E21B 7/027* (2013.01);
(Continued)

(58) Field of Classification Search
CPC . E21B 7/025; E21B 1/02; E21B 7/027; E21B 19/086; E21B 19/087; E21B 19/20; B25D 17/28; E21D 20/003; E21D 20/00
See application file for complete search history.

(56) References Cited

U.S. PATENT DOCUMENTS 986,160 A 3/1911 French
2,204,352 A * 6/1940 Fuchrer ..... E21B 19/24 384/24
(Continued)

FOREIGN PATENT DOCUMENTS

CA 2415330 A1 6/2004
CA 2435531 A1 1/2005
(Continued)

*Primary Examiner* — Nathaniel C Chukwurah
*Assistant Examiner* — Mobeen Ahmed
(74) *Attorney, Agent, or Firm* — Norton Rose Fulbright Canada LLP

(57) ABSTRACT

A manually operated pneumatic rock drill positioner for mining shaft wall boring, said positioner comprising: an articulated boom having one end for releasable coupling to
(Continued)

a mobile ground platform and another end opposite said one end thereof; a rigid elongated drill turret defining a main body with an exposed outer wall, an inner wall opposite said outer wall, and first side edge wall and second side edge wall opposite said first side edge wall, and first end and second end opposite said first end, a lengthwise rail member integrally mounted to said turret outer wall; a carriage slidingly engaging said rail member, said carriage for slidingly carrying a pneumatic drill head over said turret exposed outer wall for reciprocating motion thereof between said first end and second end thereof; drive means for power actuating said carriage sliding motion along said rail member; a cradle member releasably anchored to said boom another end and defining a well sized and shaped for releasable engagement by an intermediate section of said turret inner wall and said first side edge wall thereof; anchoring means for anchoring said turret to said cradle member; first coupling means for pivotally connecting said turret to said cradle member for relative pivotal movement of said turret about said cradle member along a first axis; second coupling means for pivotally connecting said turret to said cradle member for relative tilting movement of said turret about said cradle member along a second axis transverse to said first axis; all in such a way that the intersection of said first axis and second axis coincides with the center of gravity of said turret positioner and is located within said turret main body, providing a balanced load-free manual operation of the positioner.

20 Claims, 30 Drawing Sheets

(51) Int. Cl.
*E21D 20/00* (2006.01)
*B25D 17/28* (2006.01)
*E21B 19/086* (2006.01)

(52) U.S. Cl.
CPC ..... *E21B 19/086* (2013.01); *E21D 20/00* (2013.01); *E21D 20/003* (2013.01)

(56) References Cited

U.S. PATENT DOCUMENTS 2,389,558 A * 11/1945 Slater ..... E21B 7/025 52/116
2,766,012 A * 10/1956 Hale ..... E21B 7/022 173/193
2,789,789 A * 4/1957 Lea, Jr. ..... E21B 19/24 173/44
2,958,514 A * 11/1960 Lee ..... E21B 19/084 175/122
3,132,703 A 5/1964 Larcen
3,565,184 A * 2/1971 Gustafsson ..... E21B 7/025 173/28
3,721,304 A * 3/1973 Hanson ..... E21B 7/022 173/2
3,923,276 A * 12/1975 Kimber ..... E21B 7/025 248/654
4,232,849 A * 11/1980 Kimber ..... E21B 7/022 173/193
4,267,892 A * 5/1981 Mayer ..... E21B 7/025 173/194
4,364,540 A * 12/1982 Montabert ..... E21B 7/025 173/195
4,398,850 A * 8/1983 Talvensaari ..... E21D 20/006 173/193
4,410,049 A * 10/1983 Molin ..... E21B 7/022 173/193
4,703,811 A * 11/1987 Lam ..... E02D 7/16 173/164
5,114,279 A * 5/1992 Bjerngren ..... E21D 20/006 405/259.1
6,752,221 B1 6/2004 Morissette
6,981,559 B2 * 1/2006 Rubie ..... E21B 19/087 173/184
7,607,866 B2 * 10/2009 Eddowes ..... E21B 19/086 211/70
9,157,321 B2 * 10/2015 Nystrom ..... E21D 20/003
2002/0119014 A1 * 8/2002 Coombs ..... E21D 20/025 405/269
2004/0118577 A1 * 6/2004 Morissette ..... B25D 17/28 173/38
2004/0178004 A1 * 9/2004 MacDonald ..... E21B 7/024 175/162
2005/0023015 A1 * 2/2005 Argento ..... B25D 17/28 173/36
2008/0169113 A1 * 7/2008 Rubie ..... E21B 7/025 173/141
2010/0218998 A1 * 9/2010 Saf ..... E21B 19/08 175/122
2011/0248092 A1 * 10/2011 Nelson ..... E21B 7/025 238/127
2015/0167463 A1 * 6/2015 Jones ..... E21B 11/00 175/220
2015/0218944 A1 * 8/2015 Nystrom ..... E21D 20/006 700/275

FOREIGN PATENT DOCUMENTS

EP 0083899 B1 1/1986
FR 1556244 A 2/1969
FR 1563343 A 4/1969
FR 2353703 A1 12/1977
FR 2452587 A1 10/1980
GB 1233032 A 5/1971

* cited by examiner

SELF-SUPPORTING PNEUMATIC HAMMER POSITIONER WITH UNIVERSAL JOINT

CROSS REFERENCE DATA

This patent application is a national phase application under 35 U.S.C. 371 of international patent application PCT/CA2015/000464 filed Aug. 17, 2015, which claims Paris convention priority based upon U.S. patent application No. 62/038,463 filed 18 Aug. 2014, each of which is hereby incorporated by reference in its entirety.

BACKGROUND OF THE INVENTION

It is well known that the mining sector is one of hard work. Workers in the mining industry are subject to significant physical constraints. Indeed, some mining operations require that workers handle heavy tools that generate intense vibrations to accomplish their tasks manually.

For example, securing mining shaft ceilings or "vaults" requires the installation of anchors in the rock wall to support a wire mesh to prevent collapsing pieces of fractured rock falling on to workers. Indeed the nature of the soil as well as normal drilling and blasting cause the release of debris from the top vault of the mining tunnel. It is necessary to secure these ceiling arches by attaching a wire mesh that retains and prevents this rocky debris from falling over workers who travel in the mine shaft tunnels. To enable these lattices to retain large amounts of debris, and thus to be able to support heavy loads, to hang spacedly over the mine shaft ground level, the lattices must be fitted with efficient and elongated (e.g. 1.8 to 2.4 meters long) anchor rods. The process of fixing the mesh consists of drilling a hole of corresponding depth, then inserting capsules of epoxy resin, the insertion of the anchor rod which itself perforates the resin capsules, the mixing of the resin to start the reaction, to support the rod in place for curing the resin and finally the bolting of a support plate for holding the mesh to the projecting end of the rod. This still remains a delicate operation requiring human eye-hand coordination.

For several decades, workers used specialized tools such as jack legs and stopers designed for this kind of work and mine environments. In fact, these are the last remaining manual tools used in mining operations. They are still being used because of their particular qualities and benefits. Jack legs and stopers provide workers a power assist feed in their drilling operations. These tools may be used in a variety of ways with respect to spatial positioning, while taking only small spatial volume, they enable spatial positioning and a multi-directional orientation quickly and with few constraints. The positioning and orientation call upon human eye-hand coordination, and this goes without saying, this is a very efficient mechanism, quick and reliable. However, these tools are very heavy and generate higher vibration levels.

Along with other equipment, the jack leg is a tool weighing approximately 57 kilograms and which generates high levels of vibration. Thus, these mine workers sustain significant physical exertion during work and are exposed to very significant vibrations while working in a hazardous and often hostile environment. Therefore they are exposed to a high risk of injury as well as risk to develop certain occupational borne diseases associated, among others, to exposure to body vibrations.

Several studies and research in recent decades (e.g. Health and Safety Executive, UK) have established more clearly the detrimental effects to the human body when handling for a long time vibrating tools. Known in the medical literature under the name HAV (Hand Arm Vibration), a correlation is set between the level of vibration, duration of exposure and the likelihood of developing an occupational disease. The various types of hand drills (jack legs and stopers) in the mining industry generate vibration levels that far exceed the acceptable threshold. So the scientific community recognizes that prolonged exposure to high levels of vibration may have adverse effects on health, and more specifically: repetitive hand movements may be a factor of ischemia; unnatural hand positions (maladaptive grip, variable work posture and height) cause additional constraints and workloads which can lead to hardening of muscles and ligaments, which can cause injuries; tight grip (used with one hand, with vibrations, that we do not want to release) causes vascular and sensorimotor disorders; mechanical stress exerted on the palms of the hands (against handling blows, strike movements on components, working with a steel tool); vibrations; and Raynaud's syndrome (ischemia in the fingers, finger vasoconstriction induced by the nervous system). These factors are most incapacitating for workers with possible permanent physical damage. These factors in addition to increasing the specific health hazard of mine workers also have longer-term consequences.

A study by the Quebec Research Institute of Health and Safety at Work estimated at $CAN 4.64 billion the annual cost of occupational injuries, and $ CAN 40,180 annually per incapacitated worker the cost of an occupational disease whose origin comes from a repetitive work. According to the same study, the costs reach $ CAN 89,227 per year in the mining sector. This sector is thus at a high level of priority for the Health and Safety Board (CSST) to find ways to reduce these costs.

SUMMARY OF THE INVENTION

The invention therefore relates to a manually operated pneumatic rock drill positioner for mining shaft wall boring, said positioner comprising: an articulated boom having one end for releasable coupling to a mobile ground platform and another end opposite said one end thereof; a rigid elongated drill turret defining a main body with an exposed outer wall, an inner wall opposite said outer wall, and first side edge wall and second side edge wall opposite said first side edge wall, and first end and second end opposite said first end, a lengthwise rail member integrally mounted to said turret outer wall; a carriage slidingly engaging said rail member, said carriage for slidingly carrying a pneumatic drill head over said turret exposed outer wall for reciprocating motion thereof between said first end and second end thereof; drive means for power actuating said carriage sliding motion along said rail member; a cradle member releasably anchored to said boom another end and defining a well sized and shaped for releasable engagement by an intermediate section of said turret inner wall and said first side edge wall thereof; anchoring means for anchoring said turret to said cradle member; first coupling means for pivotally connecting said turret to said cradle member for relative pivotal movement of said turret about said cradle member along a first axis; second coupling means for pivotally connecting said turret to said cradle member for relative tilting movement of said turret about said cradle member along a second axis transverse to said first axis; all in such a way that the intersection of said first axis and second axis coincides with the center of gravity of said turret positioner and is located within said turret main body, providing a balanced load-free manual operation of the positioner.

In one embodiment, a releasable brake means releasably locks said cradle member at a selected pivoted and tilted orientation of said turret.

An elongated handle may be carried along at least one of said turret first side edge, said turret second side edge, and said turret first end.

In one embodiment, said cradle member consists of an L-shape frame having a first leg and a second leg, said first leg defining an outer end provided with a transverse first sleeve, said second leg defining an outer end provided with a transverse second sleeve opposite said first transverse sleeve with said first axis orthogonal to said second axis, said first coupling means consisting of a first pivot mount member pivotally engaging said first sleeve and releasably interlocking with said boom another end and with said turret first side edge wall, said second coupling means consisting of a second pivot mount member pivotally engaging said second sleeve and releasably interlocking with said turret inner wall.

In one embodiment, a drill bit guide member is carried at said turret first end of said exposed outer wall thereof, for centering axial reciprocating displacement of a drill bit from the drill head carried by said carriage. Said guide member could consist of a scissor-like blade assembly defining first and second elongated blades each having an inner end pivotally carried by said turret first end of exposed outer wall, and an outer end movable away from each other in an opened condition and toward each other in a closed condition, a pair of recesses formed inwardly at said blades outer ends and defining jaws complementarily shaped for free slide through engagement therebetween of the drill bit in their said closed condition. Each of said guide member blades could also include another recess formed intermediate said blades inner end and outer end, and further including a spear stinger having a main body and a leading end portion, integrally carried by said turret carriage and slidingly movable between a first position, where said leading end portion thereof clears said guide member another recesses, and a second position where said leading edge portion thereof extends through and beyond said guide member another recesses, wherein said spear stinger extends generally parallel to said turret for providing stabilizing engagement with the mine shaft wall during drill operation.

In one embodiment, said turret main body is hollow, and wherein said carriage drive means consists of a pneumatic ram coupled to intersecting cables in a cables, trolley and pulleys system lodged within said turret main body hollow and providing a reduction ratio for the pneumatic ram.

In one embodiment, said turret carriage further includes a number of pillow blocks, integrally mounted to an underside of said carriage facing said turret exposed wall, each said pillow block defining an elongated cylindroid female tenon joint means, and wherein said rail member further includes a corresponding number of cylindroid male tenon joint means projecting flanges slidingly retainingly engaged into said female tenon joint means of said pillow blocks.

In one embodiment, there is provided third means for relative movement of said cradle member relative to said articulated boom another between a first operatively position, where said turret is orthogonal to said boom, and a second storage position, where said turret is closely spacedly parallel to said boom.

In one other embodiment of the invention, there is provided a manually operated pneumatic rock drill positioner and rock drill combination for mining shaft wall boring, comprising: an articulated boom having one end for releasable coupling to a mobile ground platform and another end opposite said one end thereof; a rigid elongated turret defining a main body with an exposed outer wall, an inner wall opposite said outer wall, and first side edge wall and second side edge wall opposite said first side edge wall, and first end and second end opposite said first end, a lengthwise rail member integrally mounted to said turret outer wall; a carriage slidingly engaging said rail member; pneumatic drill head slidingly mounted to said carriage and movable over said turret exposed outer wall in reciprocating motion thereof between said first end and second end thereof, a drill bit projecting from said drill head; a pneumatic drive power actuating said carriage sliding motion along said turret rail member; a drill power unit, operatively connected to said drill head and for mounting over the mobile ground platform; a cradle member releasably anchored to said boom another end and defining a well sized and shaped for releasable engagement by an intermediate section of said turret inner wall and said first side edge wall thereof; an anchoring member anchoring said turret to said cradle member; a first pivotal coupling pivotally interconnecting said turret to said cradle member along a first axis; a second pivotal coupling pivotally connecting said turret to said cradle member for relative tilting movement of said turret about said cradle member along a second axis transverse to said first axis; all in such a way that the intersection of said first axis and second axis coincides with the center of gravity of said turret positioner and is located within said turret main body, providing a balanced load-free manual operation of the positioner A releasable brake means could releasably lock said cradle member at a selected pivoted and tilted orientation of said turret.

In this one other embodiment, an elongated handle could be carried along at least one of said turret first side edge, said turret second side edge, and said turret first end.

In this one other embodiment, said cradle member consists of an L-shape frame having a first leg and a second leg, said first leg defining an outer end provided with a transverse first sleeve, said second leg defining an outer end provided with a transverse second sleeve opposite said first transverse sleeve with said first axis orthogonal to said second axis, said first coupling means consisting of a first pivot mount member pivotally engaging said first sleeve and releasably interlocking with said boom another end and with said turret first side edge wall, said second coupling means consisting of a second pivot mount member pivotally engaging said second sleeve and releasably interlocking with said turret inner wall.

In this one other embodiment, a drill bit guide member, carried at said turret first end of said exposed outer wall thereof, providing centering axial reciprocating displacement of said drill bit from the drill head carried by said carriage. Said guide member could consist of a scissor-like blade assembly defining first and second elongated blades each having an inner end pivotally carried by said turret first end of exposed outer wall, and an outer end movable away from each other in an opened condition and toward each other in a closed condition, a pair of recesses formed inwardly at said blades outer ends and defining jaws complementarily shaped for free slide through engagement therebetween of the drill bit in their said closed condition.

In this one other embodiment, a drill bit guide member could be carried at said turret first end of said exposed outer wall thereof, providing centering axial reciprocating displacement of said drill bit from the drill head carried by said carriage; said guide member consisting of a scissor-like blade assembly defining first and second elongated blades each having an inner end pivotally carried by said turret first end of exposed outer wall, and an outer end movable away from each other in an opened condition and toward each other in a closed condition, a pair of recesses formed inwardly at said blades outer ends and defining jaws complementarily shaped for free slide through engagement therebetween of the drill bit in their said closed condition; wherein each of said guide member blades further includes another recess formed intermediate said blades inner end and outer end, and further including a spear stinger having a main body and a leading end portion, integrally carried by said turret carriage and slidingly movable between a first position, where said leading end portion thereof clears said guide member another recesses, and a second position where said leading edge portion thereof extends through and beyond said guide member another recesses, wherein said spear stinger extends generally parallel to said drill bit for providing stabilizing engagement with the mine shaft wall during drill operation.

In this one other embodiment, said turret main body could be hollow, and wherein said carriage drive consists of a pneumatic ram coupled to intersecting cables in a cables, trolley and pulleys system lodged within said turret main body hollow and providing a reduction ratio for the pneumatic ram.

In this one other embodiment, said turret carriage could include a number of pillow blocks, integrally mounted to an underside of said carriage facing said turret exposed wall, each said pillow block defining an elongated cylindroid female tenon joint means, and wherein said rail member further includes a corresponding number of cylindroid male tenon joint means projecting flanges slidingly retainingly engaged into said female tenon joint means of said pillow blocks.

A feeler finger assembly could be included in this one other embodiment, comprising a feeler finger pneumatic ram, anchored at one end to said turret, and a feeler finger rod, reciprocating from the end of said pneumatic ram opposite said one end thereof, a notch made in said drill bit guide member and said feeler finger rod supportingly slidingly engaging said notch, said feeler finger rod in extended condition for engagement with the rock wall for stabilization of said turret relative thereto. Said guide member could then comprise a pair of pneumatic actuator members, each defining a main casing fixedly mounted to opposite sides of said turret first end, and a rotatable arm, projecting from said main casing thereof, a pair of arcuate blades each integrally carried at an inner end portion thereof by a corresponding said rotatable arm and defining an outer end movable away from each other in an opened condition and towards each other in a closed condition responsively to rotation of said rotatable arms, a pair of recesses formed inwardly of said blades outer ends and defining jaws complementarily shaped from free slide through engagement therebetween of the drill bit in their said closed condition.

Said pneumatic drive could include in this one other embodiment a pneumatic cylinder carried by said turret and having a piston, a pair of pulleys pivotally carried at opposite ends of said turret, a pair of cables entrained at their intermediate section around a corresponding one of said pulleys, one end of said cables being anchored to said trolley while an opposite end of each said pulleys is anchored to said drill head carriage.

In this one other embodiment, said turret main body may be hollow, and wherein said carriage drive comprises a first pair of diametrally smaller pulley and a second diametrally larger pulley both coaxially journaled at a fixed same transverse first pivotal mount at one end of said turret; a second pair of diametrally smaller and larger pulleys, respectively, inverted relative to said first pair of pulleys and both coaxially pivotally journaled at a same fixed transverse second pivotal mount of turret, a floating pulley movably mounted between said first and second end pulleys, respectively, a trolley freely pivotally mounted to said floating pulley about a transverse third pivotal mount parallel to said first and second pivotal mounts, said trolley defining two opposite first and second ears; a first cable fixed at one end to said trolley first ear, passing around said diametrally smaller pulley of said first pair thereof, then comes back around said floating pulley, then said first cable comes back around said diametrally larger pulley of said first pair thereof beneath said first diametrally larger pulley; another end of said first cable opposite said first cable one end being anchored to the underside of said drill head carriage; a second cable fixed at one end to said trolley second ear, passing around second diametrally smaller pulley, then comes back around said floating pulley, then said second cable comes back around said diametrally larger pulley of said second pair thereof beneath said diametrally larger pulley of said second pair thereof; another end of said second cable opposite said second cable one end being anchored to the underside of said drill head carriage; a pneumatic cylinder pivotally carried at one end to said turret, a piston rod projecting from said cylinder and having a head pivotally carried at the pivotal axis of said floating pulley; wherein a reduction ratio is achieved between the drill head carriage travel and the piston stroke of said cylinder.

In one embodiment, said rail member consists of a pair of elongated first and second runner plates, bent to each form a generally V shape in cross-section, said runner plates interlocked in spaced apart fashion by a number of lengthwisely spaced planar T-shape brackets, lodged inside the V recess of said first runner plate, with anchoring assemblies lockingly engaging bores respectively made in registering flange sections defined by said runner plates, each of said brackets defining a base leg and a transverse top leg, a large circular aperture made through said bracket base leg for free through passage of pneumatic drive cylinder enclosed by said runner plates, each of said brackets further including a notch on its top leg for passage of a pair of drive cables operatively connected at one end to and entrained by said pneumatic drive cylinder and rollingly supported by end pulleys carried at opposite ends of said turret and connected at the opposite end to said carriage, wherein said runner plates are assembled as rib structure.

Two sets of composite wear resistant plates sized complementarily to said carriage could be anchored by anchoring elements to the underside of said drill head carriage, the wear plates shielding a top flange of runner plates to reduce the friction thereof.

The drill positioner is for use in a rock drilling unit employed in drilling holes in the working face of a tunnel or a mine. The hole pattern to be drilled in such faces may comprise several horizontally and vertically spaced holes which extend perpendicularly into the face or at an angle to the face, the holes being in parallel or in angled relationship to one another. Maneuverability, speed and accuracy are required where large and complex multi-hole patterns are involved.

This invention is an improvement over Canadian patent No 2 415 330 issued 15 Mar. 2005 to the Canadian corporation 4361164 Canada Inc., now assigned to the current applicant RNP industries inc., and which is incorporated herewith by way of reference. In this patent, there was disclosed a self-supporting pneumatic hammer positioner for effortless command and control by an operator of a pneumatic hammer. The positioner comprised a rigid elongated template having a handle at a first end portion thereof, a saddle mount for a pneumatic hammer at a second end portion thereof, and a 3-axes pivotal mount integral to an intermediate section of the elongated template. An articulated boom member was provided, having an inner end portion and an outer end portion, its outer end portion pivotally mounted to the 3-axes pivotal mount. The boom member inner end portion was pivotally mounted about a one-axis mount to a ground anchor base.

The field of this invention relates to mine shaft drilling operations. These operations are usually performed with jack leg and stoper tools in view of physical, limited working space and access constraints. The invention attempts to mimic traditional techniques and manual operations since those have been well established for several decades, while eliminating the physically detrimental loads for the workers. Therefore, maintaining close ties with "traditional" way of working will promote the learning curve i.e. will generate improved acceptance level of the invention by the workers.

BRIEF DESCRIPTION OF THE DRAWINGS

FIGS. 29B and 30B are views similar to FIGS. 29 and 30, but further showing the sliding stinger rod sequentially moving through an intermediate recess in the second embodiment of turret leading end centering guide blades for endwise counterweight engagement with the rock wall to be drilled;

DETAILED DESCRIPTION OF THE EMBODIMENTS OF THE INVENTION

Figure 1:
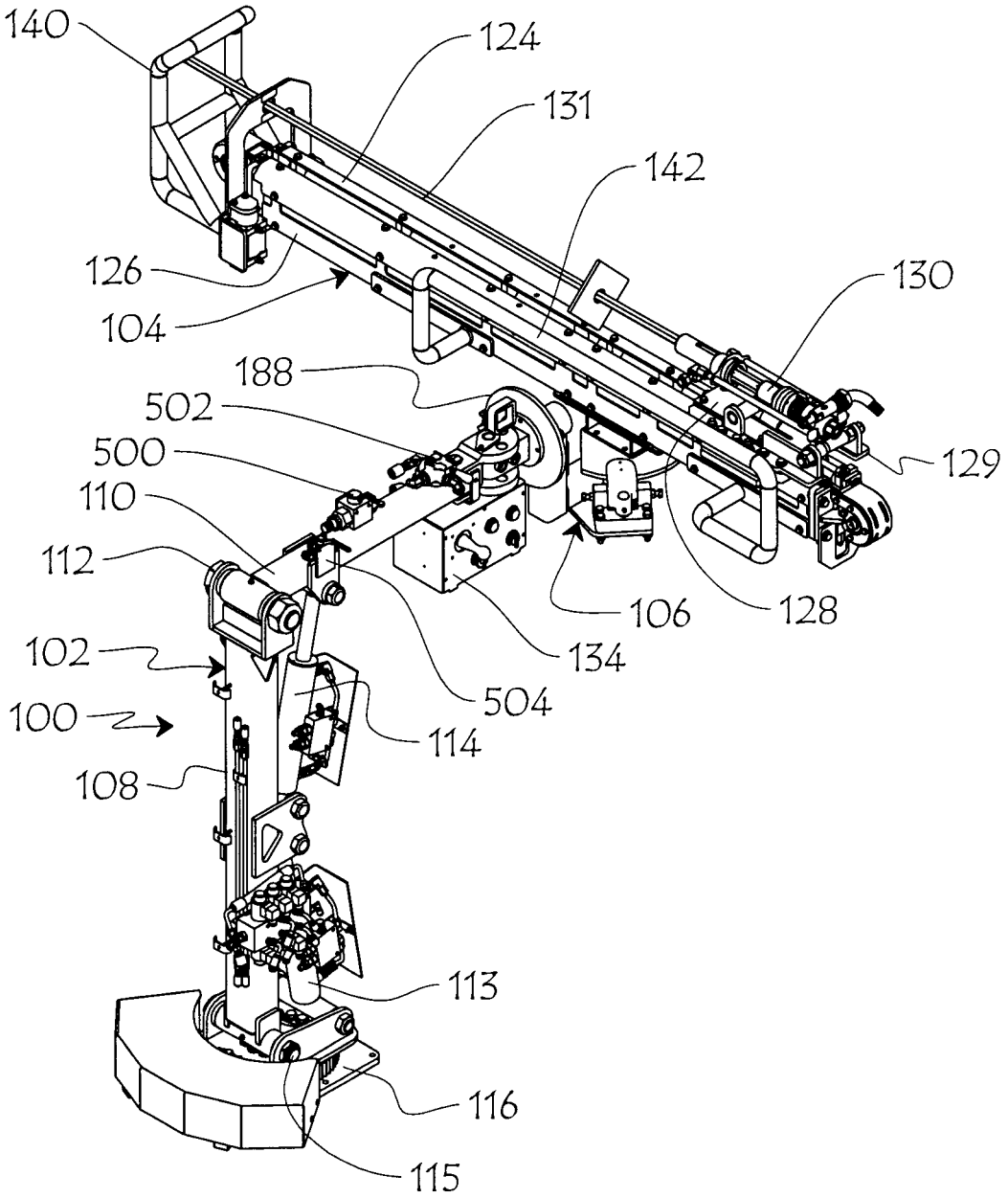
FIG. 1 is a rear end perspective view of one embodiment of rock drill positioner according to the invention, showing the articulated boom, first embodiment of turret, drill and two axes-joint linking the turret inoperative transverse position to the articulated boom outer end.

Drill positioner 100 shown in FIGS. 1 to 28 consists of an articulated mast or boom 102, a first embodiment of turret 104 and a two axes joint assembly 106 interconnecting an intermediate section of the turret with the outer end of the boom. Boom 102 includes lower and upper arms 108, 110, interconnected by a horizontal pivot mount 112. Hydraulic ram 114 pivotally biases boom upper arm 110 relative to boom lower arm 108 about pivot 112. A coupling assembly 116 is mounted to the bottom end of lower arm 108. Another hydraulic ram 113 pivots boom lower arm 108 relative to coupling 116 about pivot 115.

Figure 1A:
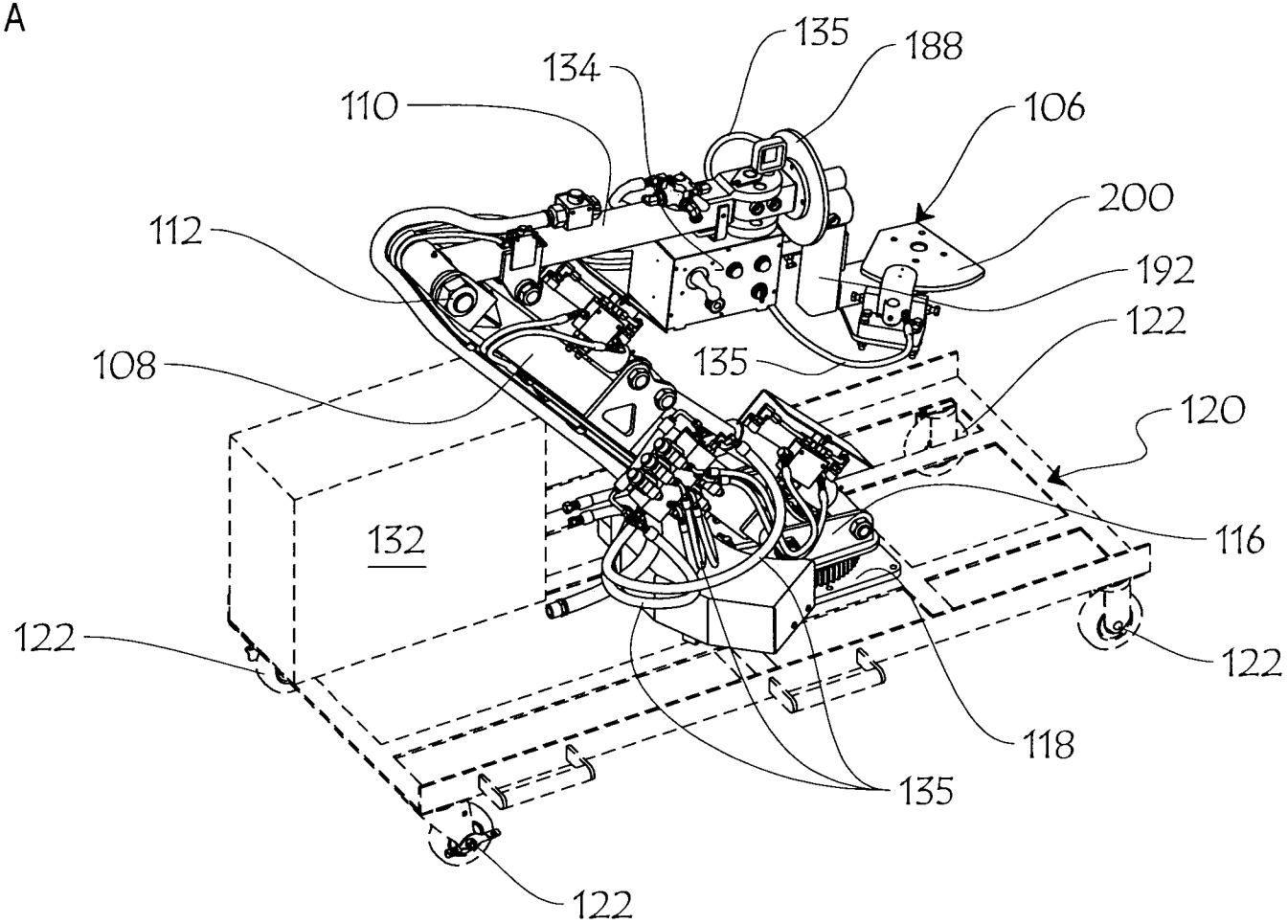
FIG. 1A is a lateral side elevational view of one embodiment of articulated boom at a smaller scale than FIG. 1, with the boom bottom end anchored to a ground movable platform shown in dotted lines, and further showing in dotted lines the compressed air power unit carried over the movable ground platform and the control box on the boom outer leg.
Figure 2:
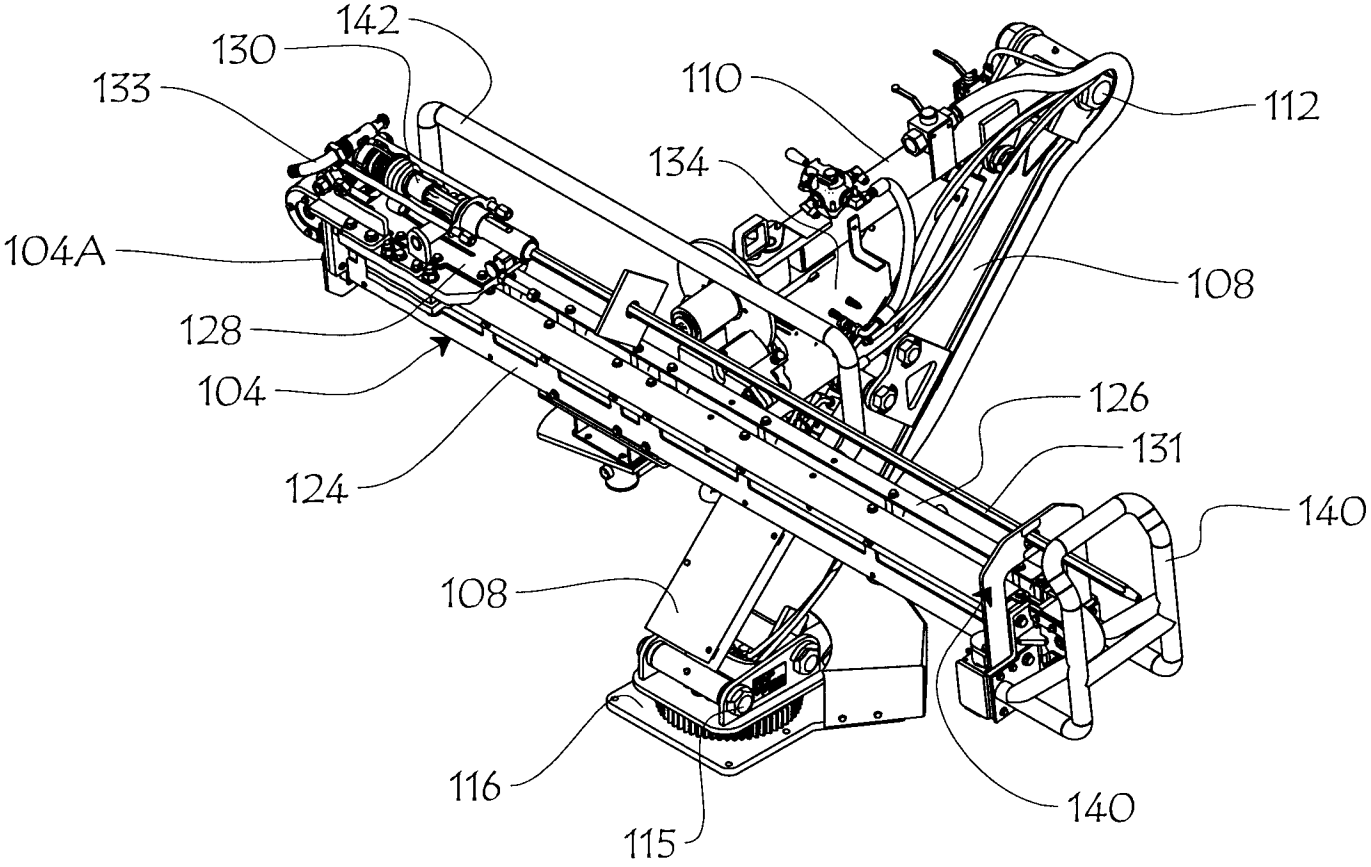
FIG. 2 is a front end perspective view of the embodiment of positioner from FIG. 1, showing a left hand side turret handle.

In one embodiment, illustrated in FIG. 1A, coupling assembly 116 releasably rotatably interlocks with a complementary rotatable coupling mount 118 over a platform 120 movably carried over ground by two pairs of corner casters 122. Couplings 116, 118, enable rotation of the boom lower arm 108 about a vertical axis. To the outer end of boom upper arm 110, opposite boom coupling 116 is releasably fixed joint assembly 106.

Elongated turret 104 includes a pair of lengthwise rails 124, 126, slidingly carrying a carriage 128 for supporting a drill head 130 with a pair of integral brackets 129. A drill bit 131 projects from one end of drill head 130, and an air inlet 133 from the opposite end thereof. In one embodiment, a pressurized air power unit 132 is carried over mobile platform 120, and a control box 134 is carried by boom upper arm 110 and operatively connected by pneumatic and hydraulic hoses 135 (FIG. 6B) and to power unit 132 to power assist components (detailed later) of the present invention for manual control thereof. A valve controlled water line is also provided to feed water to the drill bit tip to prevent overheating of the drill during operation.

In turret 104, to one end of elongated rails 124, 126 is fixedly mounted a first generally U-shape bumper 140 via transverse legs 140A, 140B. An elongated generally U-shape handle 142 is also fixedly mounted to the lateral external side edge of either rail 126 (FIGS. 1-2) or rail 124 (142', FIG. 3) about a half portion of the rail length, opposite first handle 142 via transverse legs 142A, 142B. Drill head carriage 128 is movable along rails 124, 126, between handle 142 and turret end 104A opposite end bumper 140.

Figure 20:
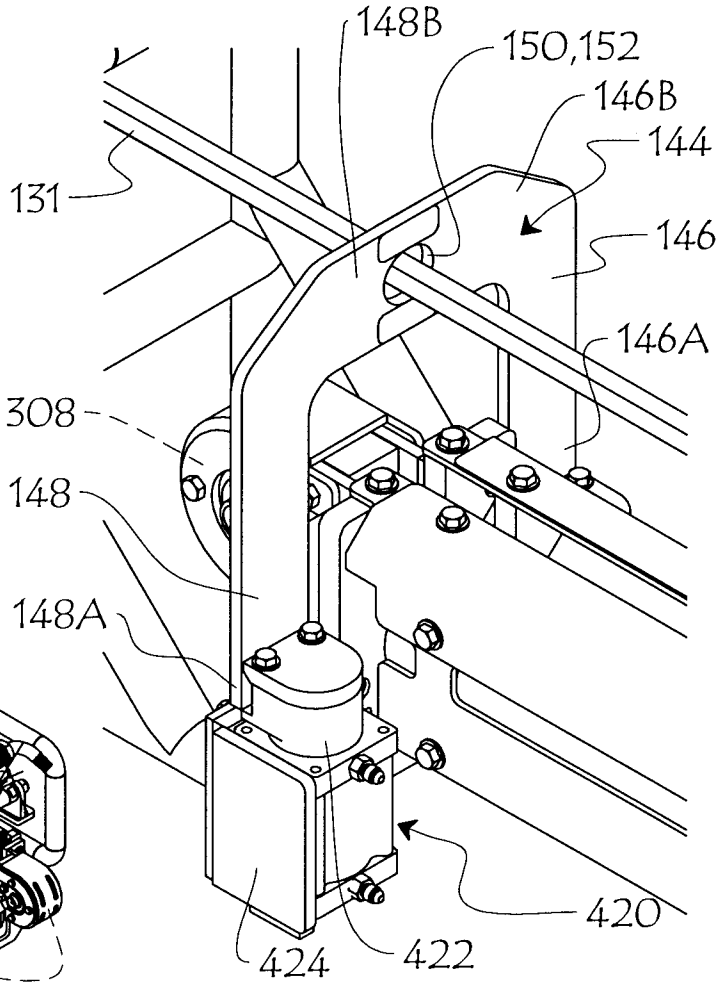
FIG. 20 is an enlarged view of the area circumscribed by arrow 20 in FIG. 19.
Figure 19:
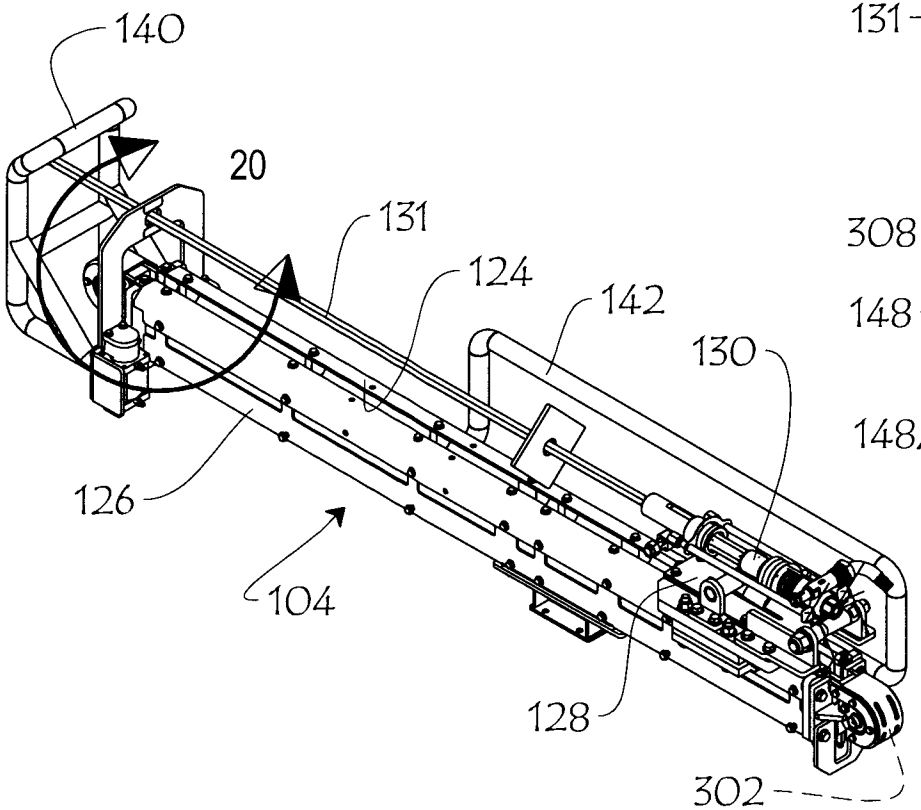
FIG. 19 is a perspective view of the first embodiment of turret and associated drill head, with the latter in its retracted condition.
Figures 21, 22:
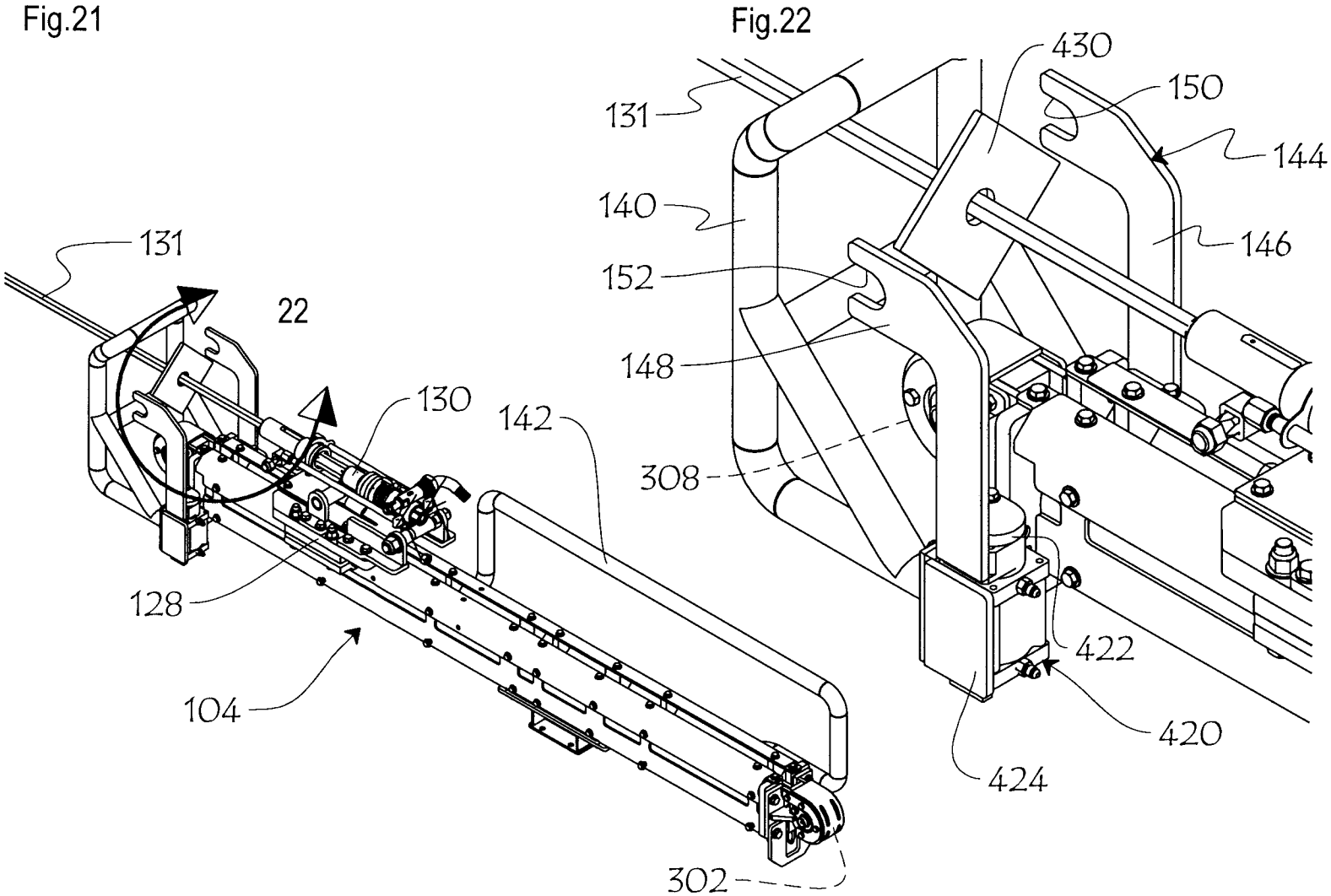
FIG. 21 is view similar to FIG. 19, but with the drill head in its extended condition.
FIG. 22 is an enlarged view of the area circumscribed by arrow 22 in FIG. 21.

As best seen in FIGS. 20 and 22, a drill bit centering system 144 is provided over turret main body 105, spacedly proximate bumper 140, to align the drill bit 131 during drilling. Centering system 144 includes two arms 146, 148, movable relative to one another. In the first embodiment of turret 104, bit centering system arms 146, 148 are power assisted, being mounted on pneumatic actuators 420 to leave free space at the level of the drill bit anchor plates 430 during the insertion of rock wall support rods. More particularly, each pneumatic actuator 420 consists of a rotatable pneumatic arm 422 projecting from pneumatic casing 424. Each blade 146, 148, is anchored at its inner end 146A, 148A, to one rotatable pneumatic actuator arm 422 projecting from a corresponding stationary pneumatic actuator casing 424, each of the two casings 424 being anchored to turret main body 105.

Centering arms 146, 148 are releasably abuttable against one another at their opposite outer end portions 146B, 148B. Each centering arm outer end portion 146B, 148B, includes a notch 150, 152, respectively, complementary to one another which when abutting against one another form a circular channel 150/152 (FIG. 20), sized and shaped for free sliding passage of drill bit 131.

Rotation of actuator arms 422 tilts blades 146, 148, from a coplanar condition (FIG. 20), where blade notches 150, 152, merge and form a circular channel for supporting passage of drill bit 131, to a condition where blades 146, 148, are spread apart generally parallel to one another (FIG. 22) with blade notches 150, 152, facing toward bumper 140. This second spread apart condition of blades 146, 148, enable free through passage therebetween of the anchoring plates 430 transversely carried by drill bit 131, when the anchoring rods are to be driven into the rock wall.

Figure 9:
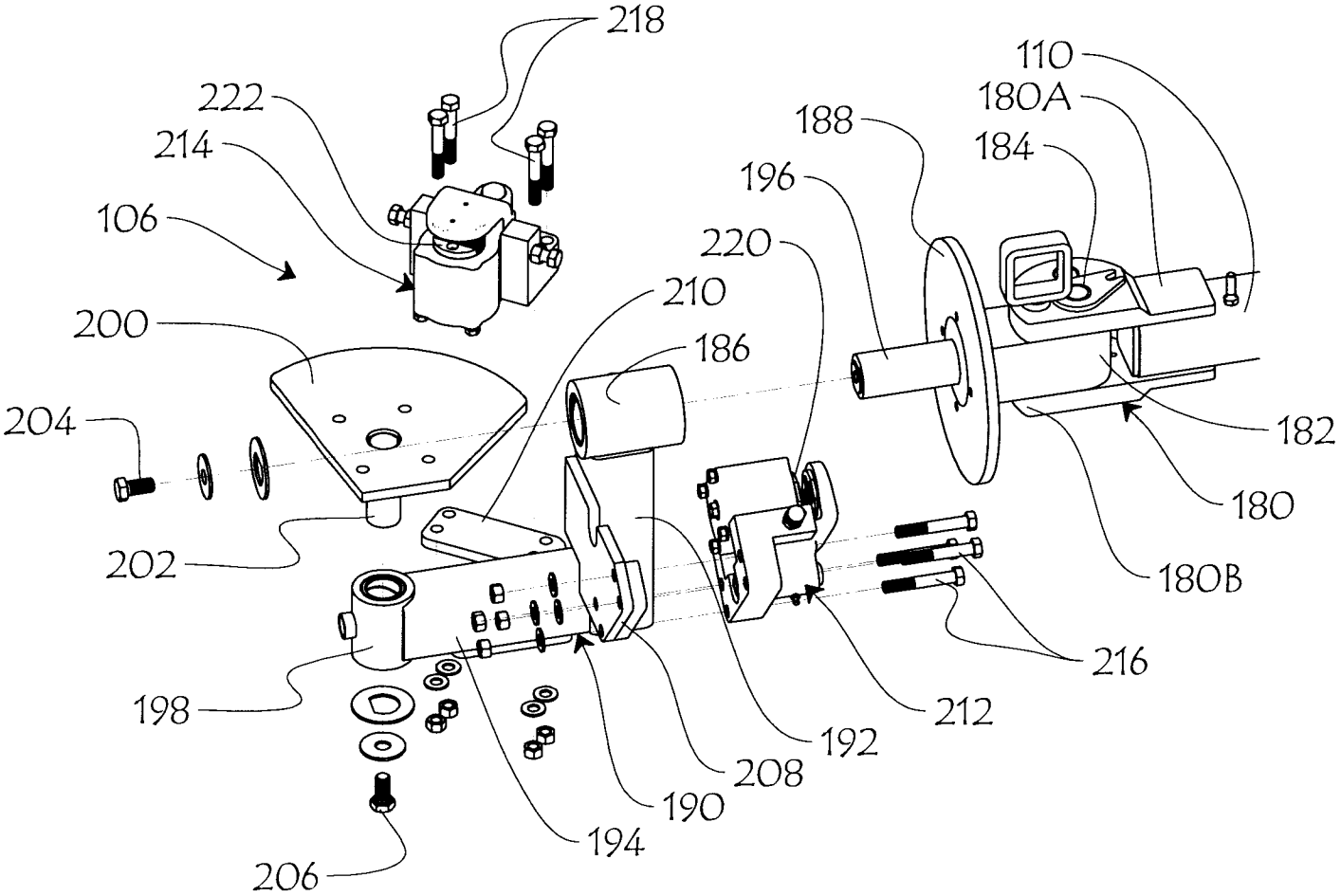
FIG. 9 is an exploded perspective view of the two pivotal axes L-shape frame connection of FIG. 1 for fixedly releasably mounting to the top outer end of the articulated boom, and also showing the brake assemblies for each of the two pivotal axes thereof.
Figure 10:
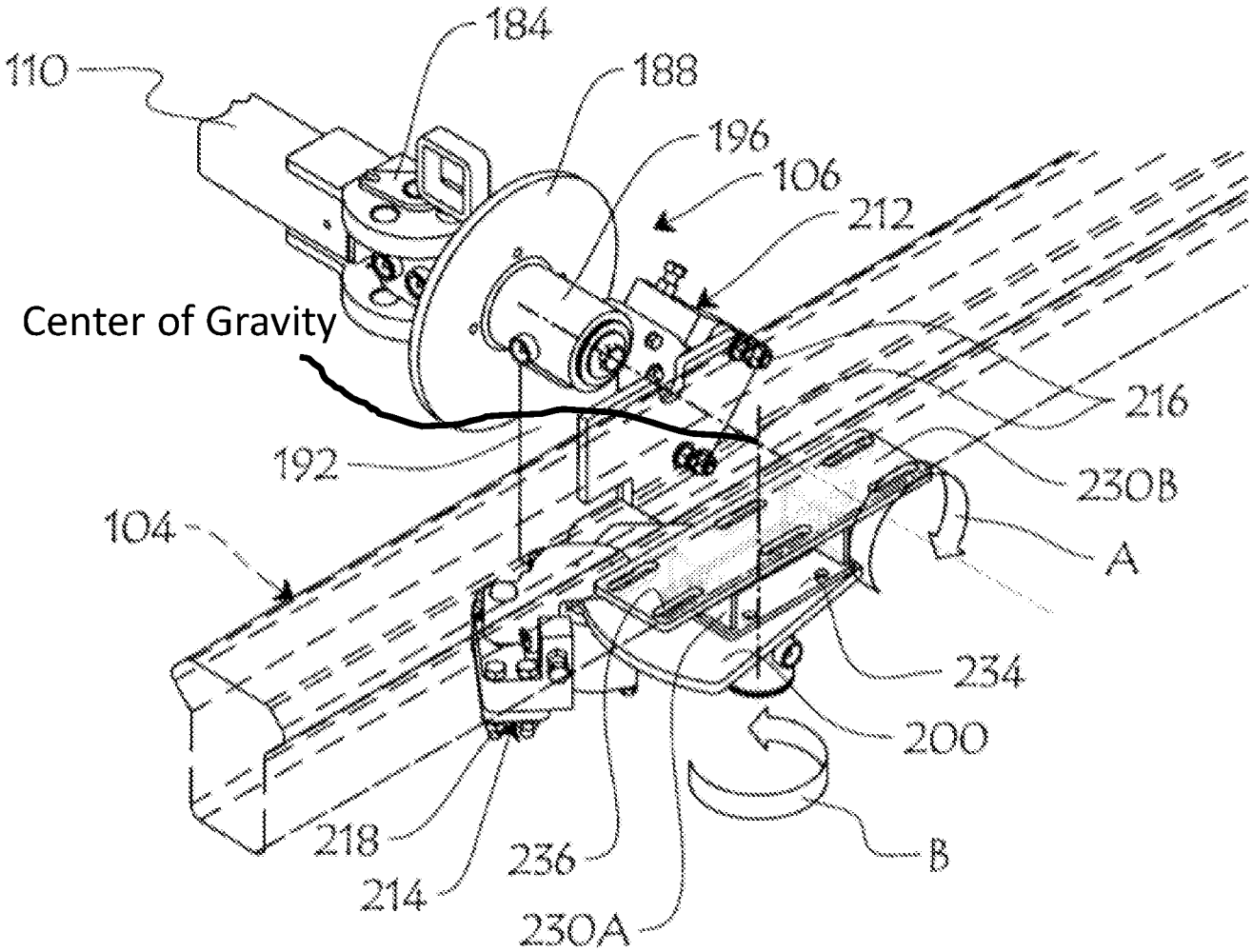
FIGS. 10, 11 and 12 sequentially suggest turret pivotal motion about the horizontal plane relative to the vertical axis pivot mount part of the L-shape frame pivot assembly, the turret of FIG. 1 shown in phantom lines for clarity of the view.
Figure 11:
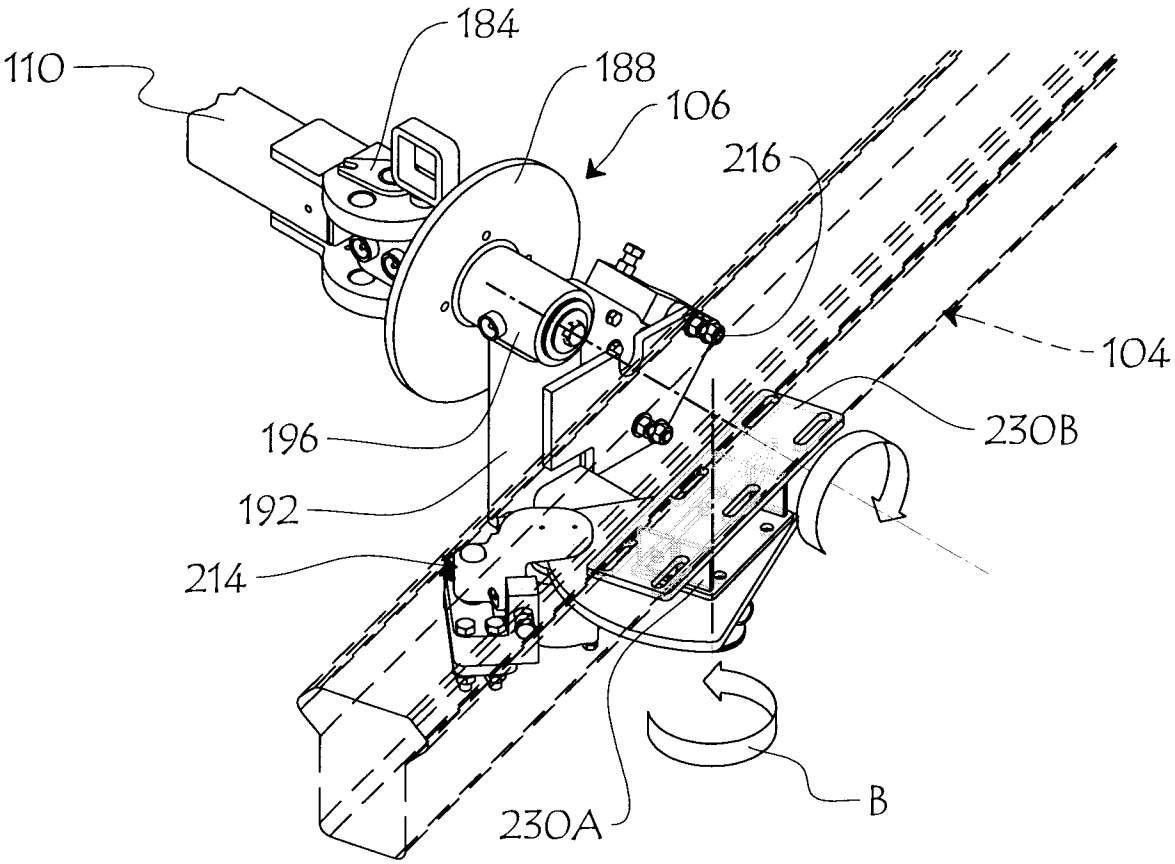
Figure 12:
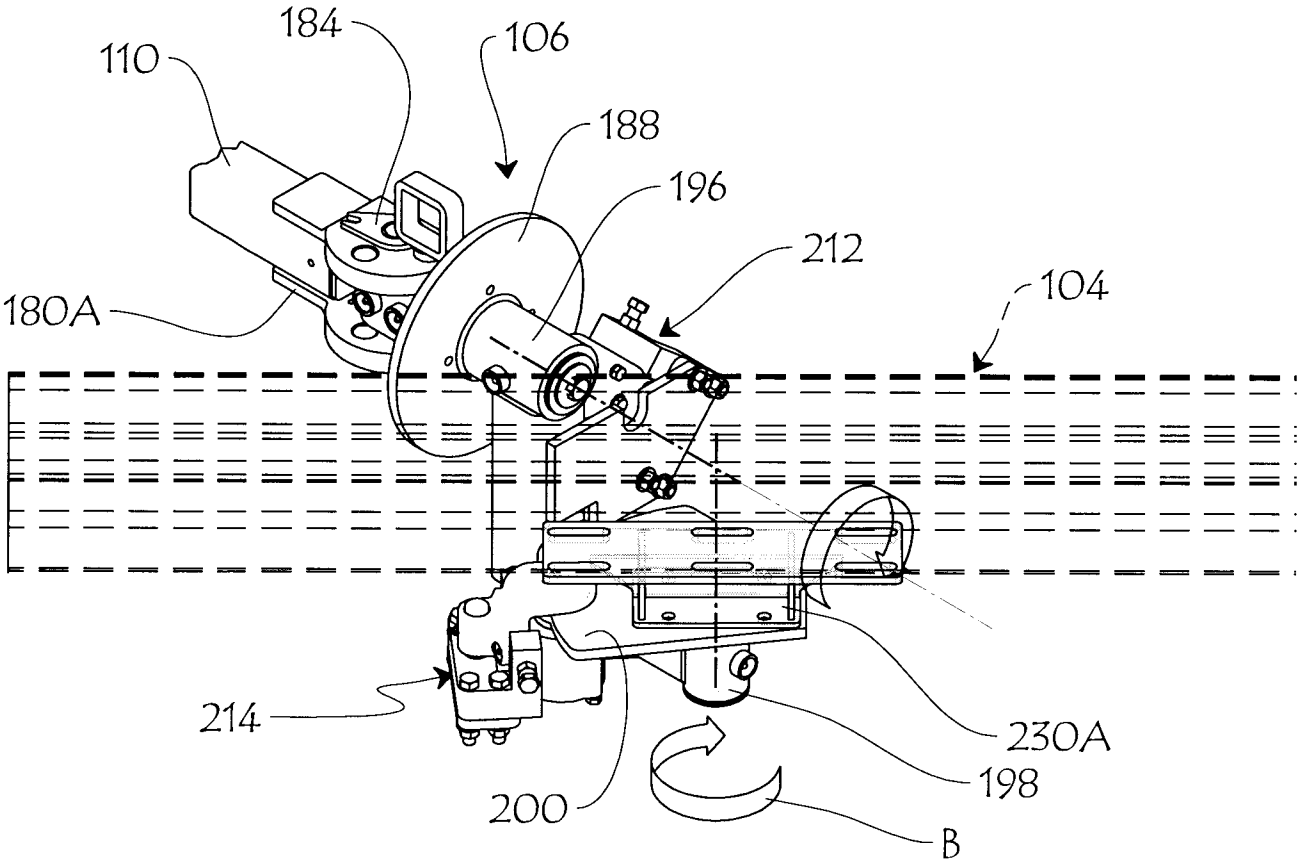
Figure 13:
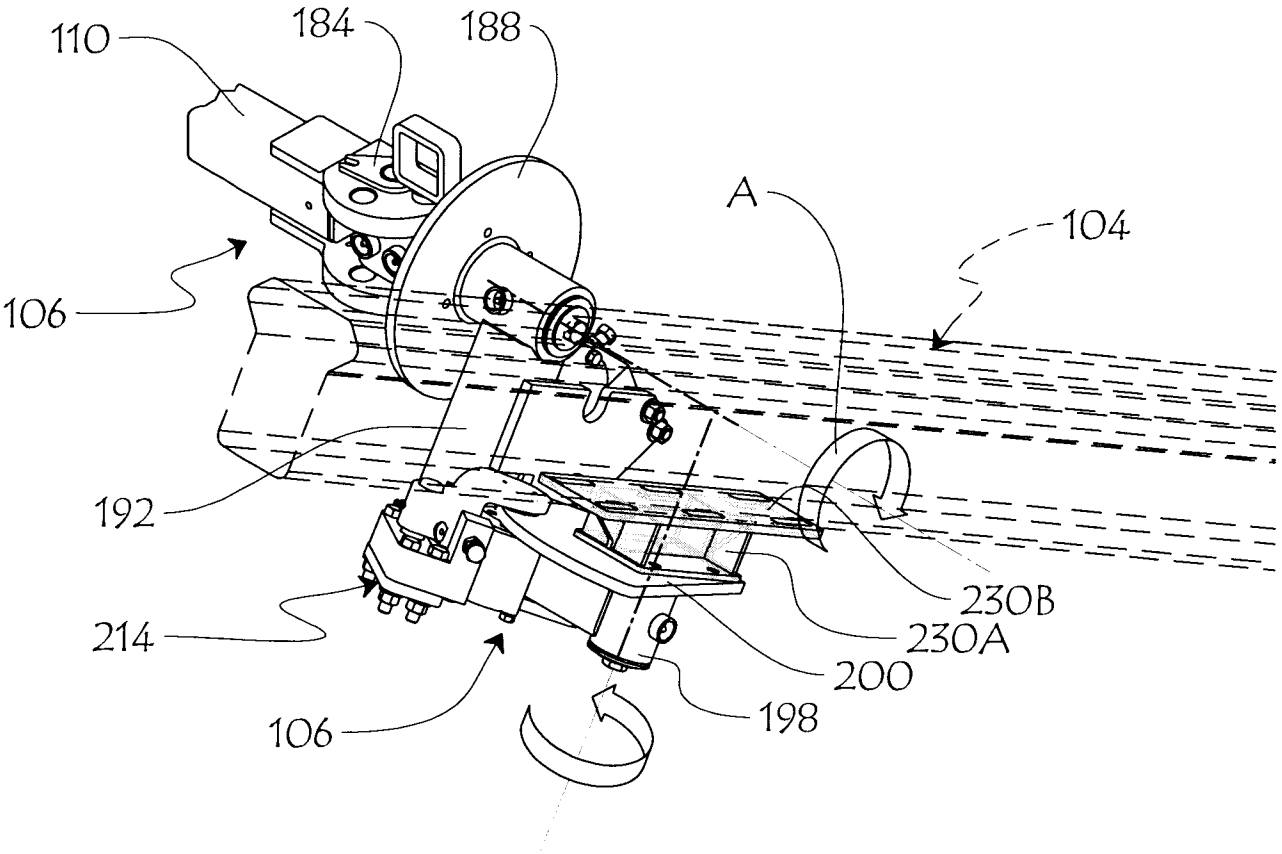
FIGS. 13, 14 and 15 sequentially suggest turret pivotal motion about the vertical plane relative to the horizontal axis pivot mount part of the L-shape frame pivot assembly, the turret of FIG. 1 shown in phantom lines for clarity of the view.
Figure 14:
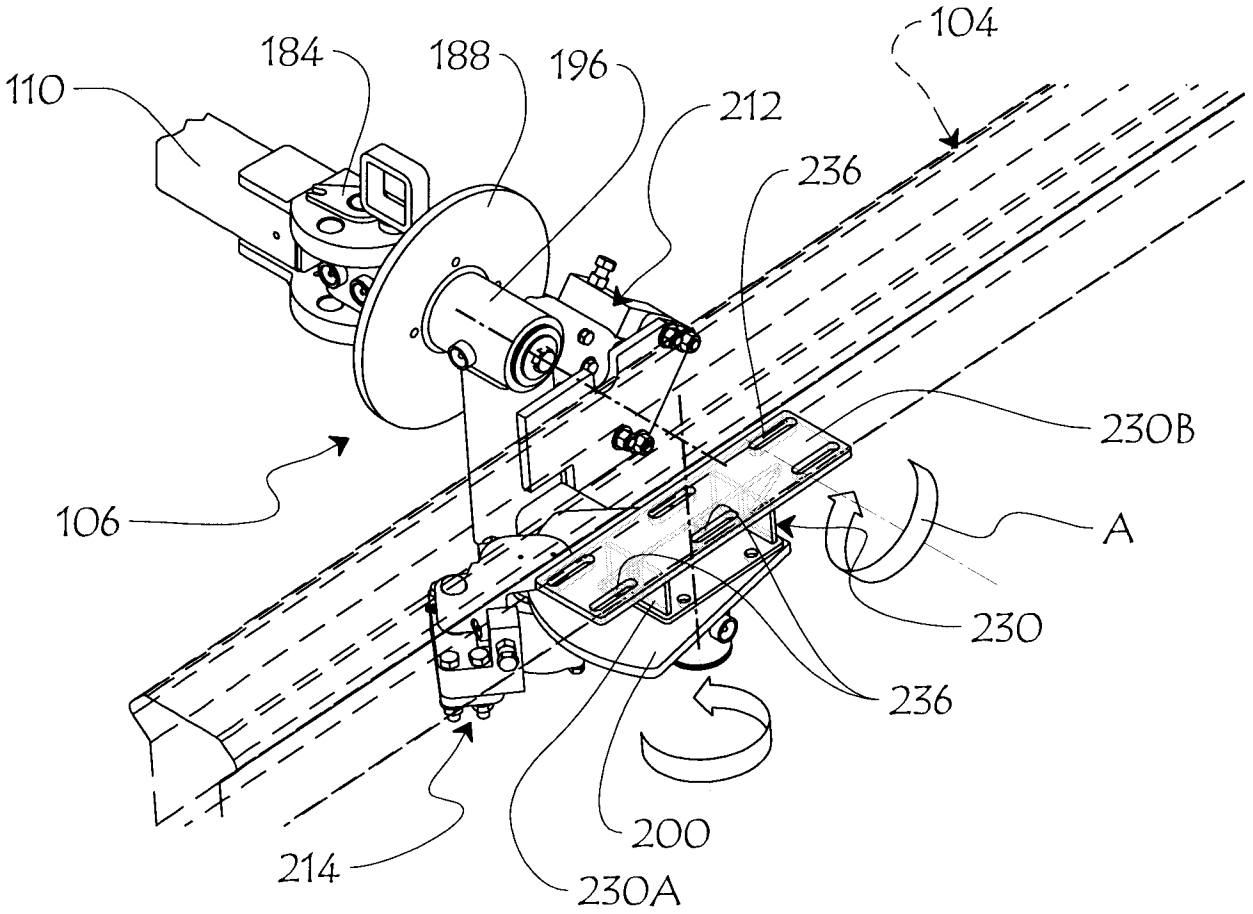
Figure 15:
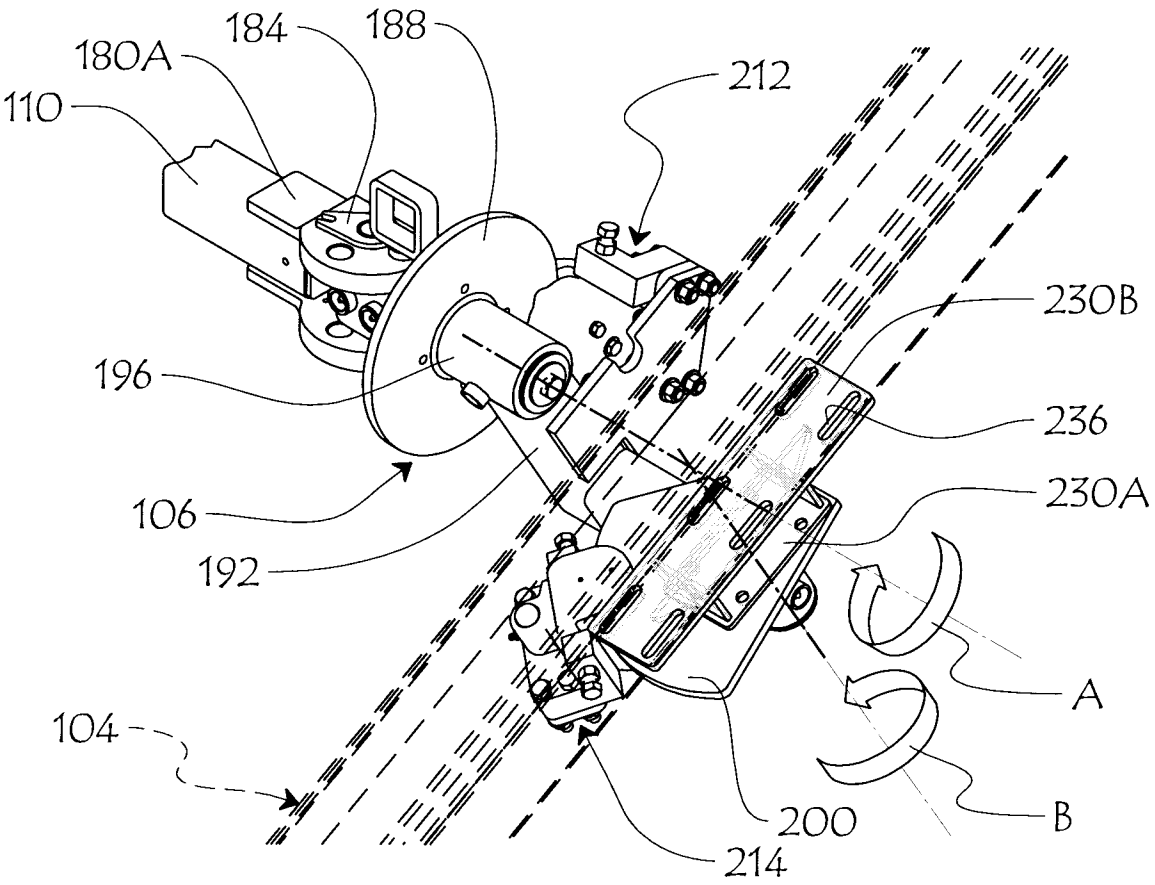
Figure 16:
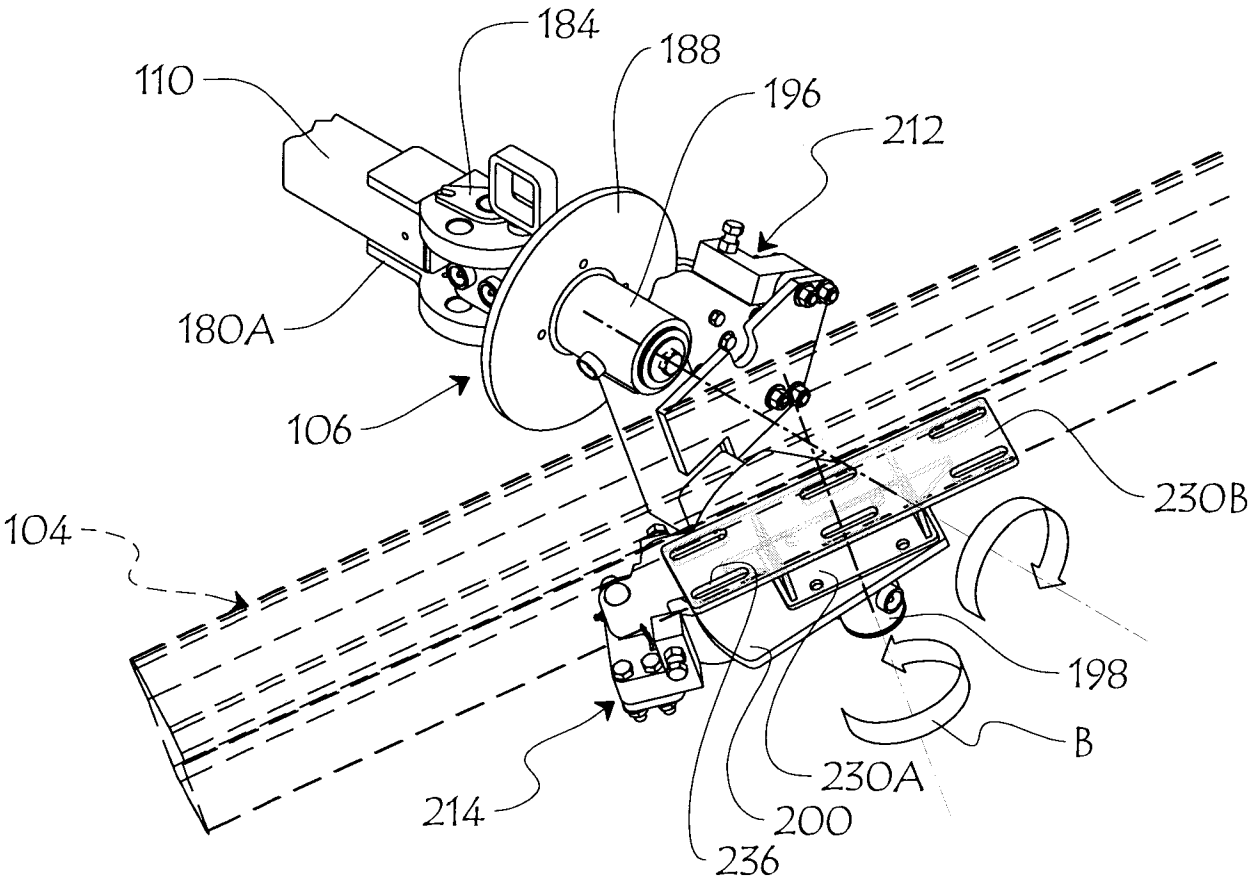
FIG. 16 is a view similar to FIGS. 10 to 15, but suggesting two axes turret tilt about the L-shape frame pivot assembly.

In one embodiment of the two axes joint assembly 106 best shown in FIGS. 5 and 9 to 16, there is shown a yoke member 180, anchored at one end 180A to the outer end of boom upper arm 110, and pivotally carrying a shaft 182 at opposite end 180A (FIG. 9). Turret storage pivotal mount 184 pivotally interconnects boom arm 180 to shaft 182 about a horizontal axis 186. A metallic circular disk drum 188 is mounted transversely to axis 186 intermediate shaft 182 and shaft extension 186. A L-shape frame 190 is further provided, defining two legs 192, 194, with a cylindroid socket 196, 198, carried at opposite ends thereof, respectively. A sector shape metallic disk drum 200 is also provided, with a cylindroid shaft 202 transversely integrally projecting therefrom. Shaft 186 is sized and shaped to fit inside socket 196, with bolt 204 interlocking same; and shaft 202 is sized and shaped to fit inside socket 198 with bolt 206 interlocking same. Each leg 192, 194, further transversely carries a bracket 208, 210, respectively. A first caliper brake member 212 is fixedly mounted to bracket 208 by bolts 216, and a second caliper brake member 214 (FIG. 17-18) is fixedly mounted to bracket 210 by bolts 218. First caliper brake member 212 includes a jaw recess 222 sized and shaped for releasable transverse engagement by a peripheral edge portion of circular brake disk 188, and second caliper brake member 214 includes a jaw recess 220 sized and shaped for releasable transverse engagement by a peripheral edge portion of sector shape brake disk 200. The pistons 224 of caliper brakes 212, 214 are power operated via hydraulic lines from the hydraulic and pneumatic lines 135.

Figure 17:
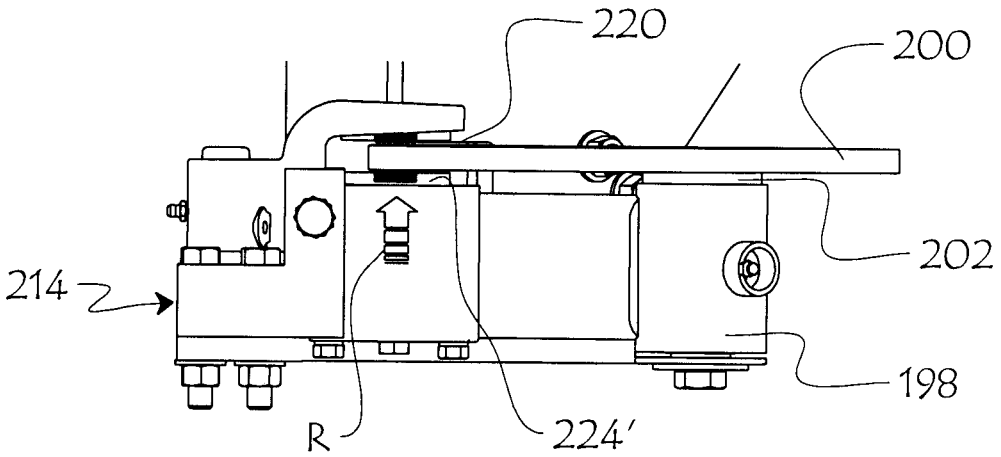
FIGS. 17 and 18, show one pivotal axis brake assembly from FIG. 1 in locking and unlocking condition, respectively, with the horizontal brake disk associated with the vertical pivotal axis.
Figure 18:
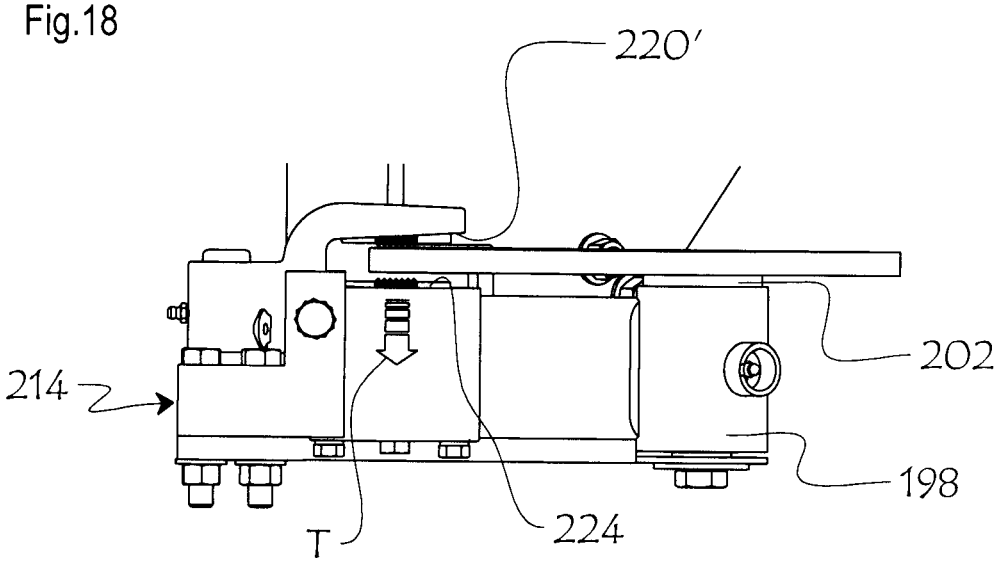

As suggested sequentially in FIGS. 17-18, piston member 224 projects through the caliper brake recess 220 from the main body of caliper brake 214, between an extended braking condition 224' (arrow R in FIG. 17), and a retracted condition 224 along arrow T (FIG. 18), to releasably frictionally interlock (FIG. 17) with the brake disk 200; and similarly, a piston member (not illustrated) projects through other caliper brake jaw recess 222 from the main body of caliper brake 212 to releasably frictionally interlock with the brake disk 188.

Figure 5:
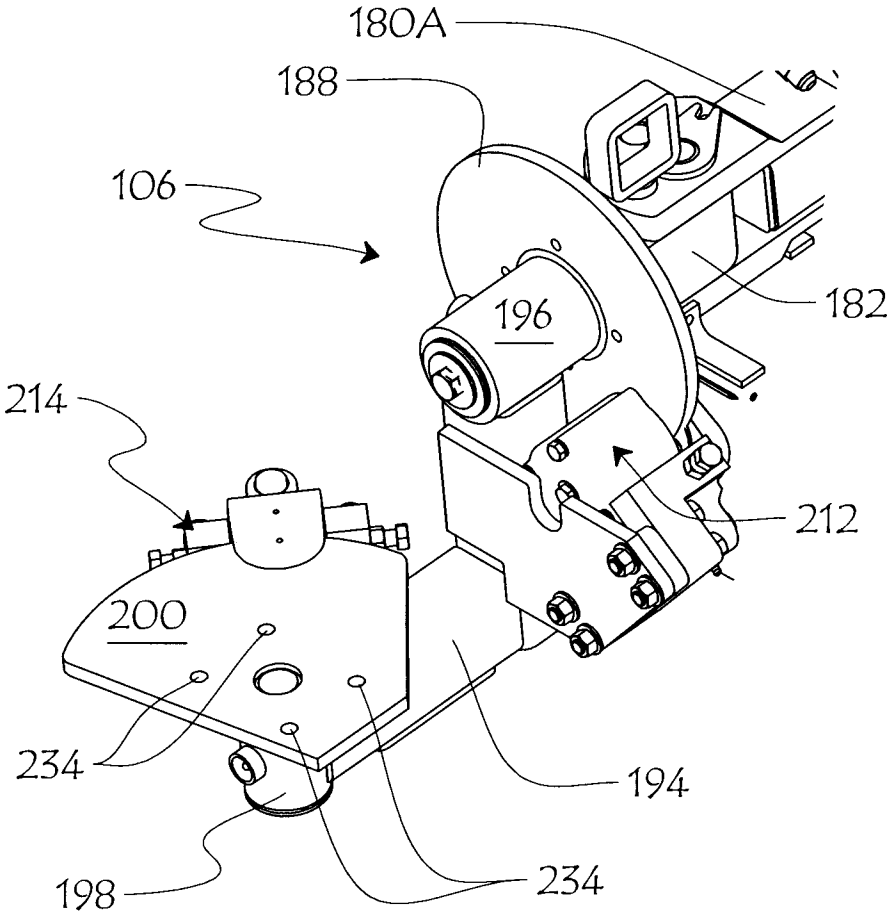
FIG. 5 is an enlarged view of the area circumscribed by arrow 5 in FIG. 4.
Figure 4:
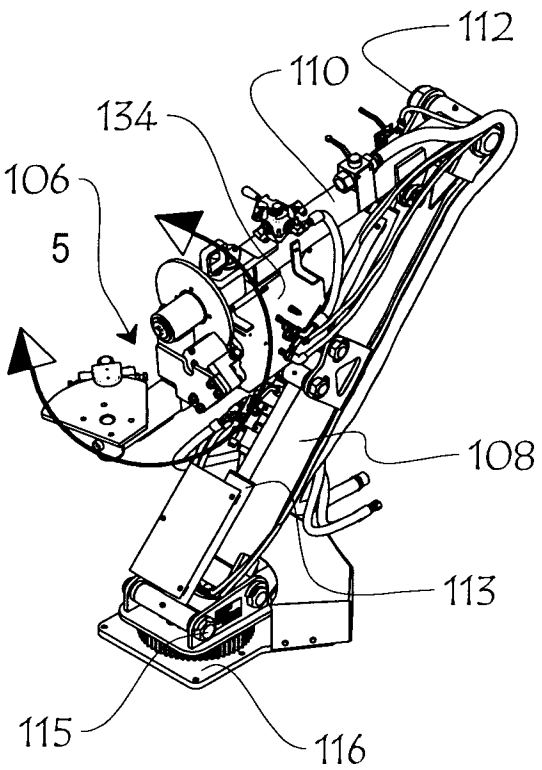
FIG. 4 is a perspective view of the articulated boom and associated L-shape two axes pivotal assembly, but with the turret and associated drill removed therefrom, and from the general perspective of FIG. 2, but at a smaller scale relative thereto.

As best seen in FIG. 5, brake disk 200 forms on its top exposed surface a flat horizontal platform, with caliper brakes 212, 214 generally clearing this area.

FIGS. 10 to 16 sequentially suggest how an intermediate section of turret 104, shown in phantom lines for clarity of the view, can be transversely supported in operative condition by brake disk platform 200 fixedly via a a T-shape connector 230. T-shape connector 230 includes a foot 230A, with two pairs of bolts 232 (see FIG. 28) for fixedly anchoring into complementary threaded bores 234 in platform 200, and an enlarged head 230B with three pairs of ovoidal slots 236 for interlock with bolts 238 (see FIG. 28) transversely projecting from the main frame of turret 104.

The two arrows in each of FIGS. 10 to 16 suggest pivotal capability of turret 104 about horizontal pivot axis 186 (arrow A) and about vertical pivotal axis 198 (arrow B), for two axes tilting turret motion about L-shape frame 190.

Figure 8A:
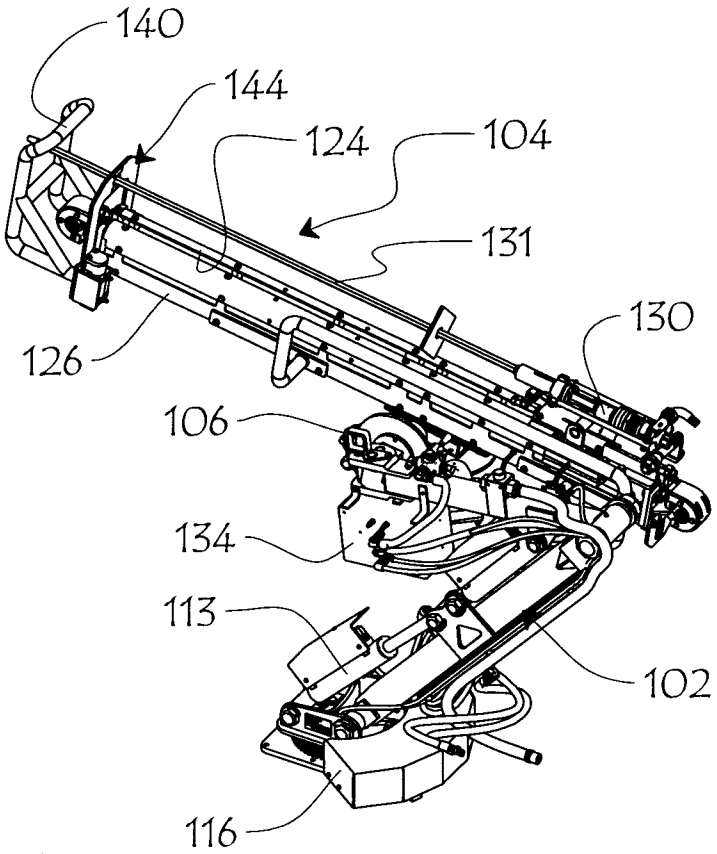
FIGS. 6A, 6B, 7, and 8A and 8B are perspective views of the embodiment of positioner of FIG. 1, showing turret tilting from a working operative condition transverse to boom 102 (FIGS. 6A and 6B), to a compact storage condition closely spaced parallel to the plane of boom 102 (FIGS. 8A and 8B), via an intermediate transitioning condition (FIG. 7)
Figure 6A:
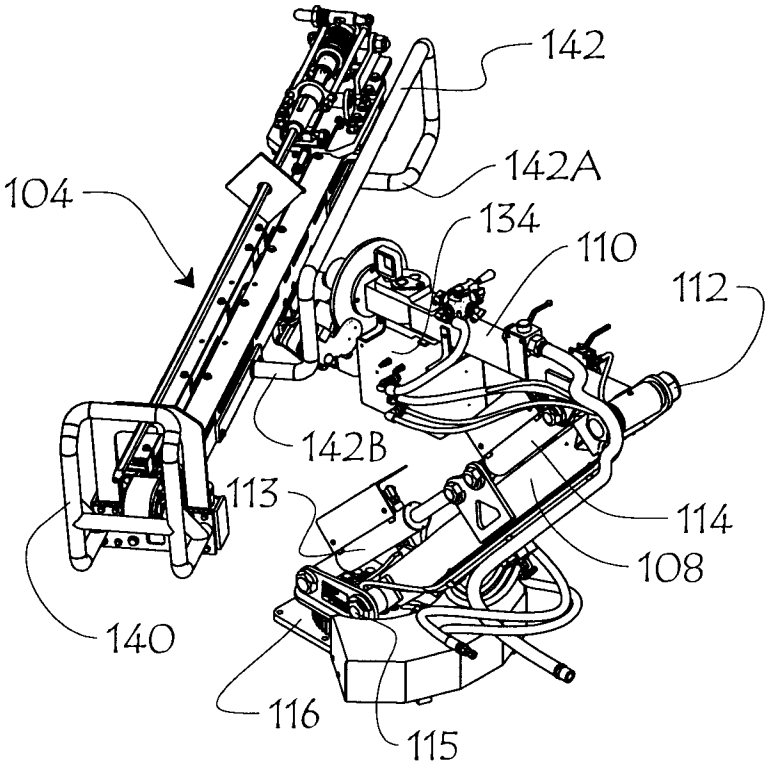
Figure 6B:
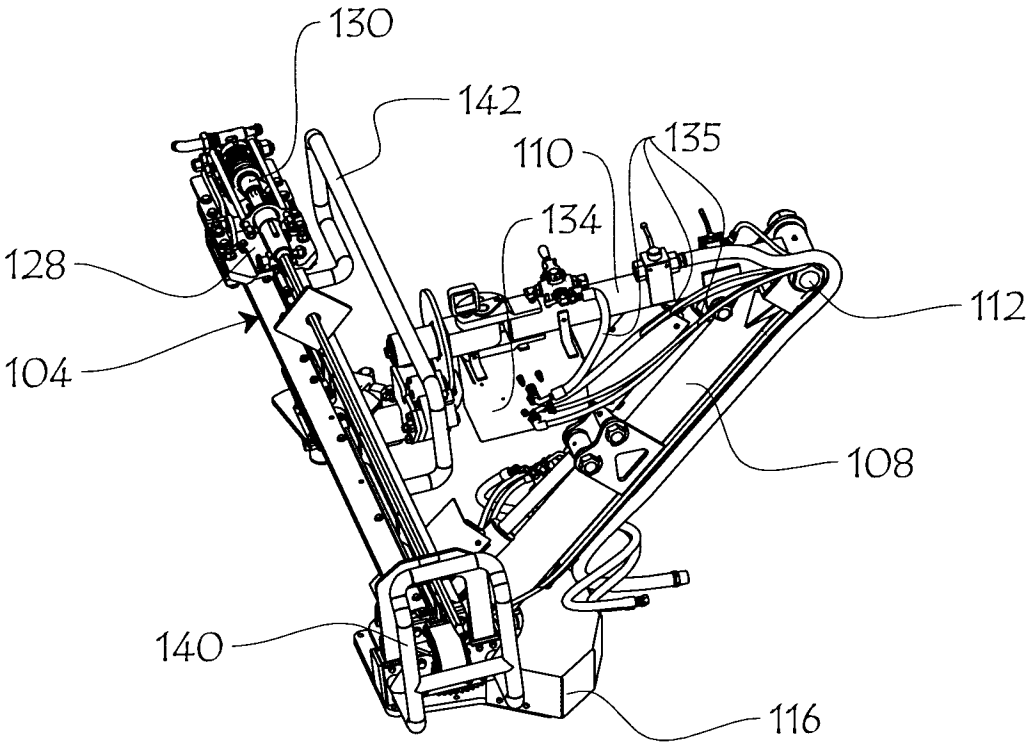
Figure 8B:
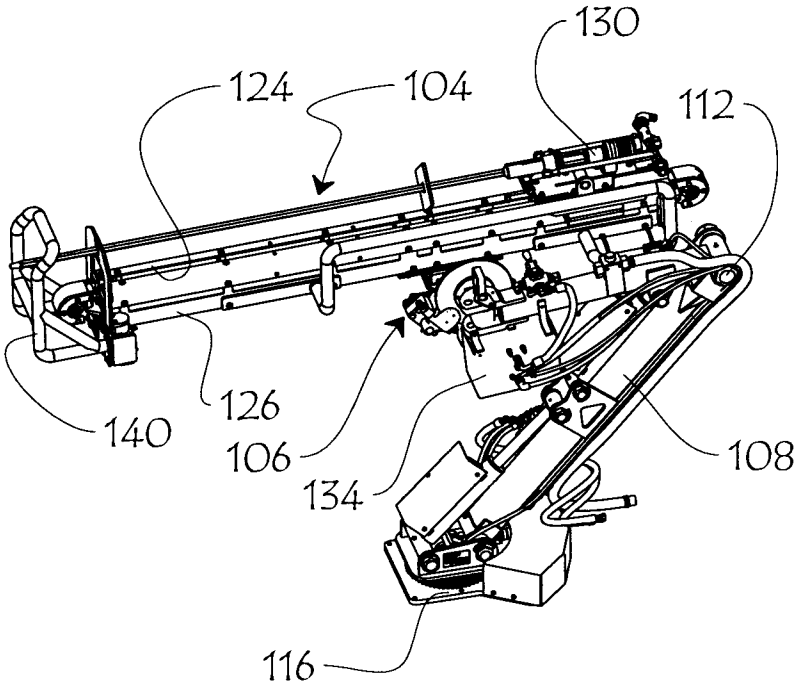
Figure 7:
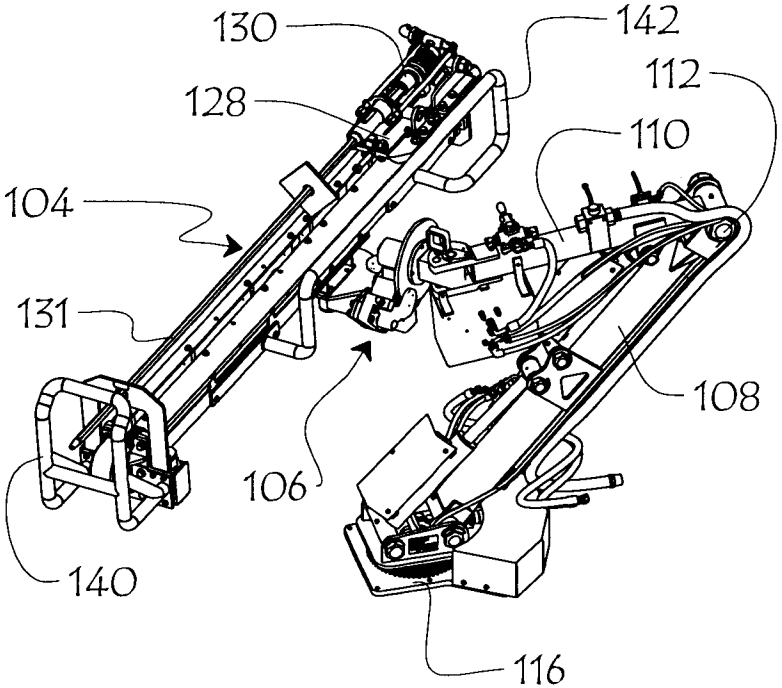

Moreover, as illustrated in the turret storage condition of FIGS. 8A and 8B, the third pivotal axis 184 between boom 110 and L-shape frame 190 provides compact storage tilting capability for turret 104, so that the latter becomes closely spacedly parallel to the plane of the boom arms 108, 110 to facilitate travel in mining tunnels in inoperative drilling mode.

However, in another embodiment, not illustrated, boom leg 100 could be coaxially integral to shafts 182 and 186, without a pivotal mount 184.

Figure 26:
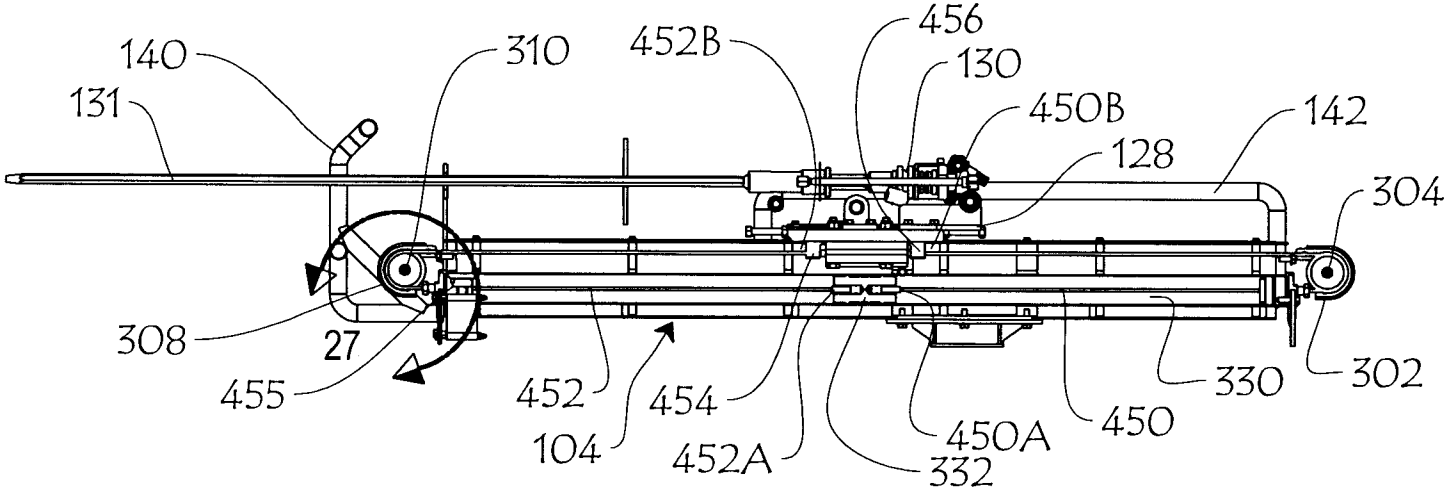
Figure 27:
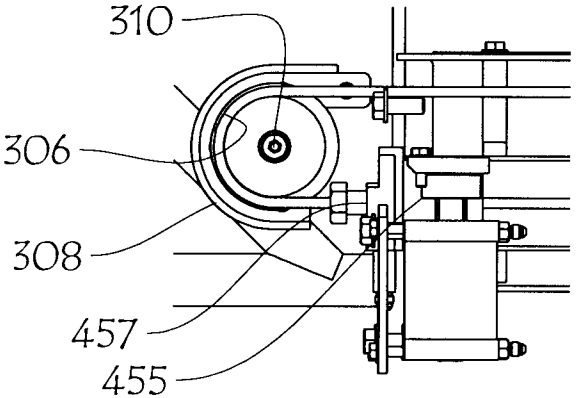
FIG. 27 is an enlarged view of the area circumscribed by arrow 27 of FIG. 26.

As best shown in FIGS. 26 and 27, in the first embodiment of turret 104, the drill head carriage drive includes a pneumatic cylinder 330 having a piston 332. A pair of pulleys 302, 308, are pivotally carried at 304, 310, to opposite ends of turret main frame 105, and an intermediate section of cable 450, 452, is entrained around each pulley 302, 308, respectively. One end 450A, 452A of cables 450, 452, is anchored to piston 332, while an opposite end 450B, 452B, thereof is anchored to brackets 454, 456 at the underside of drill head carriage 128. Air intake and outlet ports are provided at the opposite plugs 455 of turret main body 104. An adjustable air tight system 457 is provided inside plugs 455 and is engaged by cables 450, 452 to control air leaks as these cables move around pulleys 302, 308.

Figure 24:
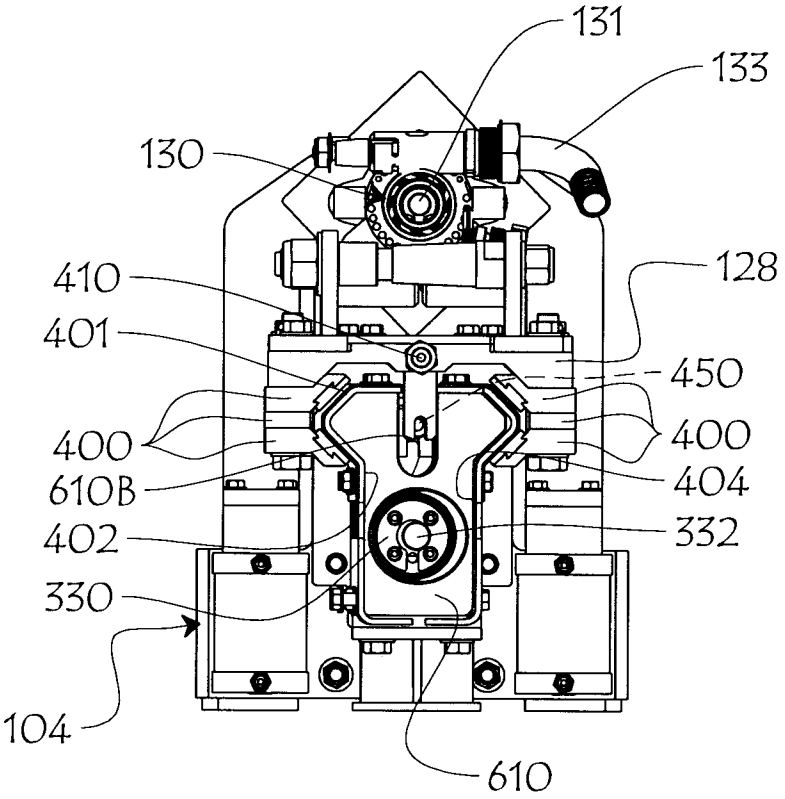
FIG. 24 is an enlarged cross-sectional view of the first embodiment of turret components at the right hand side of FIG. 1.
Figure 23:
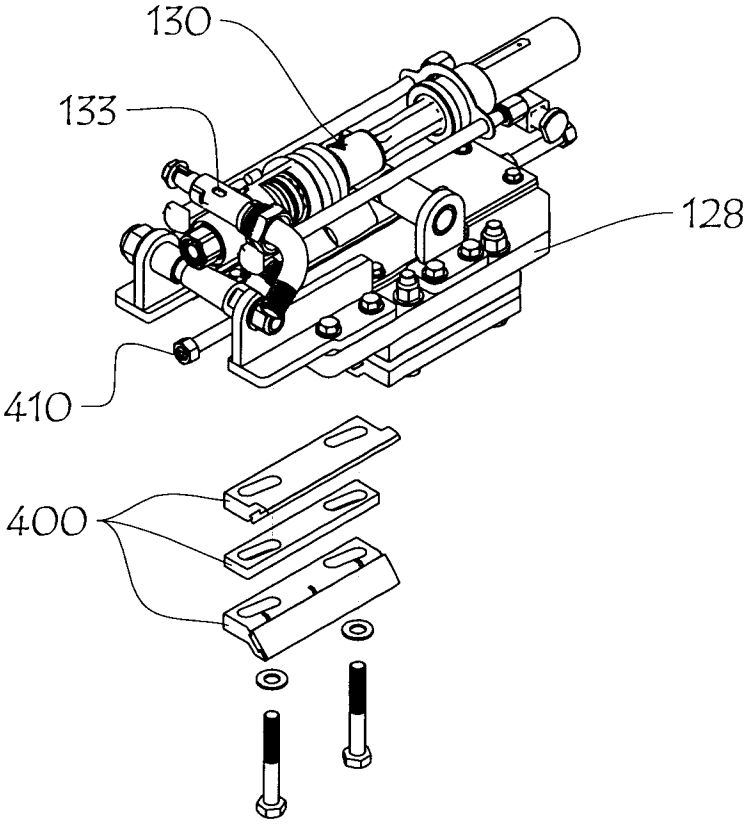
FIG. 23 is a perspective view of the drill and a partly exploded view of the associated first embodiment of turret rail carriage mount.
Figure 25:
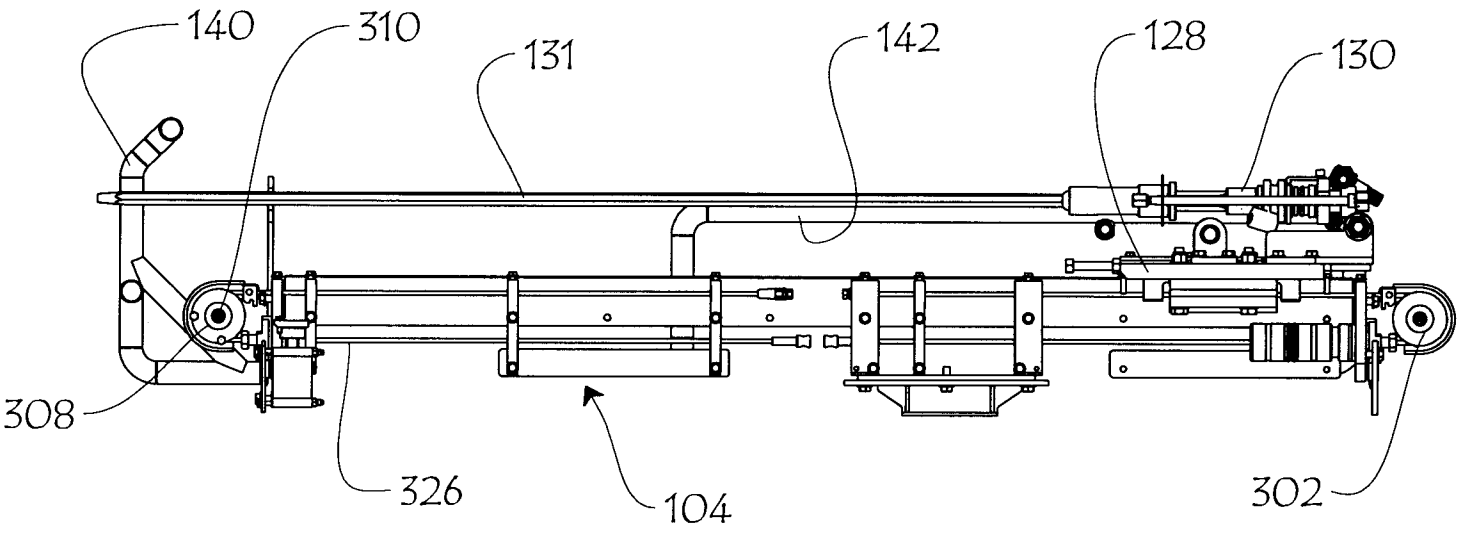
FIGS. 25 and 26 are longitudinal sectional views of the turret and associated drill head, sequentially showing how the pneumatic ram and associated cables, trolley and pulleys drive system for the drill head carriage moves the drill head from its retracted to its extended condition.

As best seen in FIGS. 23 and 24, the drill head 130 and associated carriage 128 are mounted to the main body 105 of turret 104 by guiding wear plates 400.

It is understood that the present invention provides a worker with ergonomic hardware to perform work in mines related to drilling. Indeed, the invention dampens significantly the physical efforts associated with the handling of the drill 130 and eliminates the exposure of workers to vibration. Thus the use of the present invention prevents a lot of disorders like musculoskeletal disorders as well as those related to exposure to vibration (HAV). The invention is easy to use, and causes no handling and positioning/orientation constraints, and thus reproduces for all practical purposes the same freedom to operate that a worker would have with drill in his/her hands but without the inconvenience. Furthermore the invention allows combination of several operations and provides productivity gain as much by increasing the efficiency than from reducing workers' fatigue.

The invention thus has two main goals, namely ergonomy and safety on the one hand, and productivity and efficiency improvements on the other hand. Although safety is the first goal, the invention enables efficiency improvement for mine shaft ceiling reinforcing undertakings. The combination of technical improvements and the synergy of various subcomponents enable a substantial decrease in workers' fatigue, as well as decreases of injury hazard probability levels, and bring about important improvements in terms of productivity.

It is clear that to get rid of physical loads sustained by workers in this field, power assist of tool movements is essential. Accordingly, the tool movements can be separated into three different steps: positioning; orientation; and ingress into the mine shaft rock wall.

The present invention uses the principle of hydraulic booms for the positioning of turret supported drills, for example as disclosed in Canadian patent 2 415 330. The present positioner supports a drill 130 for making holes in a mine shaft rock wall for the insertion of rock anchoring support rods.

The improvement of the present invention lies in the tool's multi-directional spatial orientation as well as in the tool's rock wall ingress parameters. The tool's rock wall ingress means makes use of sliding carriage 128 system whose movement is generated by a pneumatic cylinder 330. Elongated slider carriage 128 provides the elongated runs required for implementing the rock drilling operation.

The orientation part of the tool's motion requires expert handling, precision, reliability and quick activation. Involved are power assisted mechanical systems coupled with the tool's highest performance manual human eye-hand coordination.

Because of the relatively high weight of the drilling turret 104 and the requirement of a multi-directional manual orientation, there is a need for a mechanism that will neutralize the weight of the turret 104 and of the drill head 130, while still enabling pivotal motion about two axes 186, 202, to orient same in all directions. More particularly, the L-shape frame two axes cradle joint 106 is provided as a way to address these two requirements, while allowing workers to precisely handle (with turret handle 142) an important load in an almost effortless fashion. The concept of manual turret handling remains the most efficient, quick and reliable, the more so since the invention reduces or cancels the hazards which made this tool handling not state of the art. When turret orientation has been manually selected, brake means 188, 200, 212, 214 lock the turret main body 105 to maintain same in its selected orientation.

The L-shape frame 192, 194, is provided with releasable brake means 188, 200, 212, 214, to immobilize the turret 104 at a selected orientation along each of the two pivotal axes 196, 198. A first coarse turret positioning can be selected, and then a more precise fine manual turret orientation can be selected.

The two pivotal mounts 196, 198 of the L-shape frame articulation 192, 194, are provided with brakes 212, 214, for releasably locking the orientation of the drilling turret once it has been positioned. This way, all subsequent operations can be carried out without the turret accidentally moving again, so ensuring increased productivity. The locked pivotal mounts 196, 198, prevent accidental pivoting of the loaded turret since it is virtually impossible to pass the dynamic thrust axis through the center of gravity. This is because, during bolting or drilling, dynamic load moments are created, and these tend to induce rotation of the turret, and thus the brake means 188, 200, 212, 214, counter this effect.

The principle of operation is simple: there are two disk brakes 212, 214, (one per joint) which are automatically held by a biasing (e.g. mechanical) spring loading in default condition, so that the brake calipers 212, 214, are clamped on the disks in their neutral position, which explains the locking rotation of the pivots 196, 198. The pistons 224 of the caliper brakes 212, 214, are forcibly released by hydraulic pressure against the biasing force thereof. Thus the operator activates a switch on the control box 134, which has the effect of activating a hydraulic valve that sends a hydraulic oil pressure to the two brake pistons 224 and thereby releases the brake pistons 224. Then the operator manually tilts the drilling turret 104 in the appropriate direction and releases the control box switch which has the effect of locking once again the spring loaded caliper pistons 224. Alternate types of brake components and their controls are not excluded from the scope of the present invention.

These interlocking pivotal mounts 186, 196, 198, 202, are therefore the link between the drilling system and the manipulator arm. All the maneuverability and flexibility of the system comes from these interlocking pivotal mounts 186, 196, 198, 202, as they are controlled by spring-loaded disk brakes 212, 214, hydraulically released for added safety.

As suggested in FIGS. 6A, 6B, 7 and 8A, 8B, the storage capability of turret 104 enables the turret to pivotally engage into an inoperative, compact condition about its two axes L-shape frame pivotal assembly 192, 194 between the turret intermediate section and the articulated boom top outer end 110.

Therefore, the combination and synergy of the tool's various components with respect to their corresponding performance generate a simple and user-friendly tool since the tool remains relatively close to traditional methods, ergonomic since it requires a small physical effort for handling and operation thereof, while insulating the workers from vibrations generated by the tool, and finally, efficient and productive since it combines several operations in one and eliminates the fatigue factor in workers. Moreover, the present invention technology remains cost-competitive and will be more wear resistant in view of the hostile mine shaft work environment.

The present invention can thus be divided into three sub-systems:

1) coarse arm positioning used to take all efforts and loads associated to the handling and operation along the following axes: up/down, forward/backward, and pivotal action on the platform. Fine orientation of the turret drilling is also achieved along 3 axes: roll about horizontal axis 196, pitch about vertical axis 198, and yaw about storage pivot axis 182.
2) L-shape frame 192, 194 allows the fine orientation of the turret 104 and that firmly secures same to the articulated boom 108, 110, so as to prevent accidental turret movement, thus ensuring stability and rigidity to maintain the orientation and compensate for the dynamic loads during drilling operations against a rock wall.
3) the drilling turret 104 carries the drill head 130 and displaces the latter in the drilling axis over long distances. It also incorporates a drill bit centering system 144 to maintain the positioning thereof in the drilling axis in view of its great length. In addition, this powered release mechanism allows release of this drill bit centering system 144 to avoid any interference during the drilling action.

In one embodiment, the articulated arms 108, 110, although taking cue from the geometry of the invention positioner in Canadian Patent No 2,415,330, have been adapted to meet the specific needs of the current application of drilling at the amplitude of movement necessary to meet satisfactorily the requirements of much higher mechanical efforts. The main upright mast 108 was notably shortened and ears of the joint connecting the main mast 108 (vertical) and the secondary mast 110 (horizontal) were strengthened in response to a mechanical torsional stress much greater during a drilling operation.

This self-locking L-shaped frame 192, 194, allows with its two pivotal axes orthogonal to one another to position the turret drilling in all directions. In addition, this pivotal configuration frees the space at the points of rotation to allow positioning the center of gravity of the drilling turret at the intersection of the two pivot axes 186, 198 of the L-shape frame 192, 194. This way, handling the drilling turret 104 can be done in an effortless fashion and almost independently of its weight. Manual positioning/orientation by human worker eye-hand coordination of the turret 104 is chosen because it is a simple, quick, accurate and reliable method by its very nature.

The control system of control box 134 incorporates the "interlock" principles between the movement of the drill carriage 128 and the pivoting of the boom arms 108, 110. Indeed, the accidental activation of the unlocking of the pivoting of the boom 108, 110, when drilling carriage 128 moves forward (i.e. pushes against the mine rock wall) would have the effect of driving the assembly towards the worker. Thus, the "interlock" mechanism interrupts and purges the PNEUMATIC supply of the pneumatic cylinder 330 of the drilling turret 104 as soon as the drilling boom pivoting action is enabled.

Figure 3:
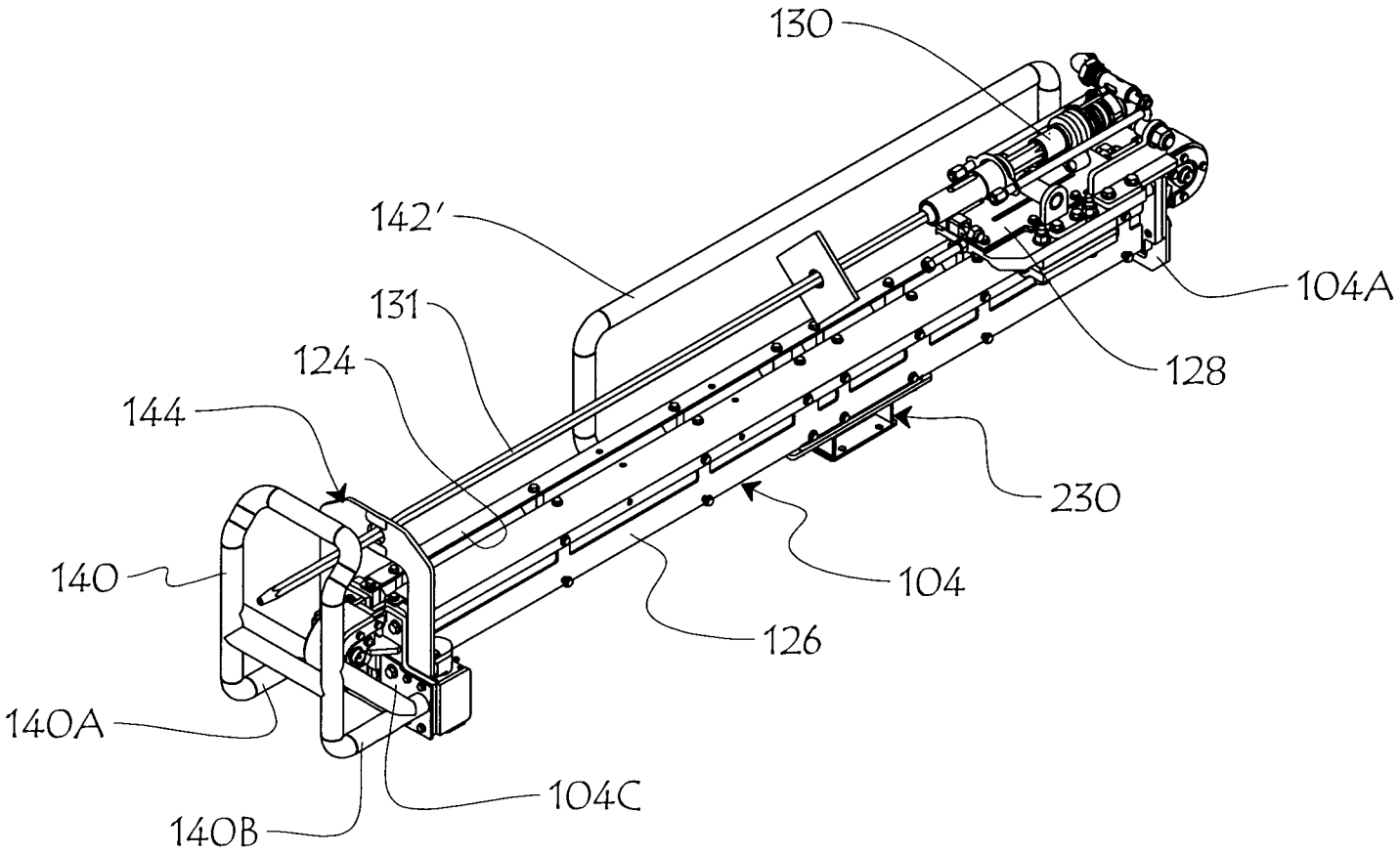
FIG. 3 is a perspective view of the first embodiment of turret, showing a right hand side turret handle.

It is noted that the present system positioner was developed to enable operator's working arm reversibility: left handed or right handed operation by workers: see handle 142 in FIG. 1 and handle 142' in FIG. 3.

Figure 28:
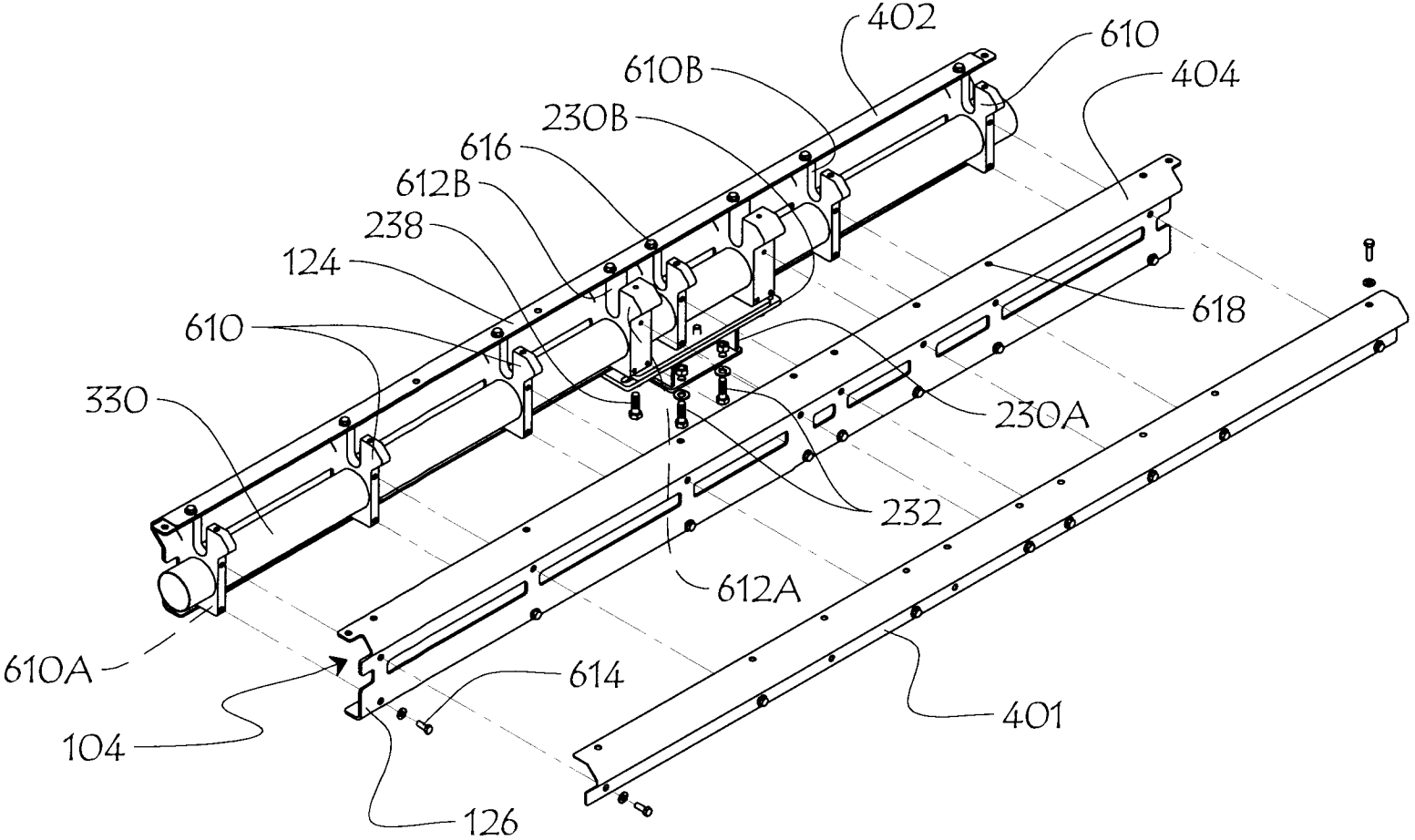
FIG. 28 is an enlarged exploded view of the first embodiment of turret from FIG. 1, showing the pneumatic cylinder from the cables, trolley and pulleys drive system of FIGS. 25 and 26, as well as the guide wear plates.
Figure 29:
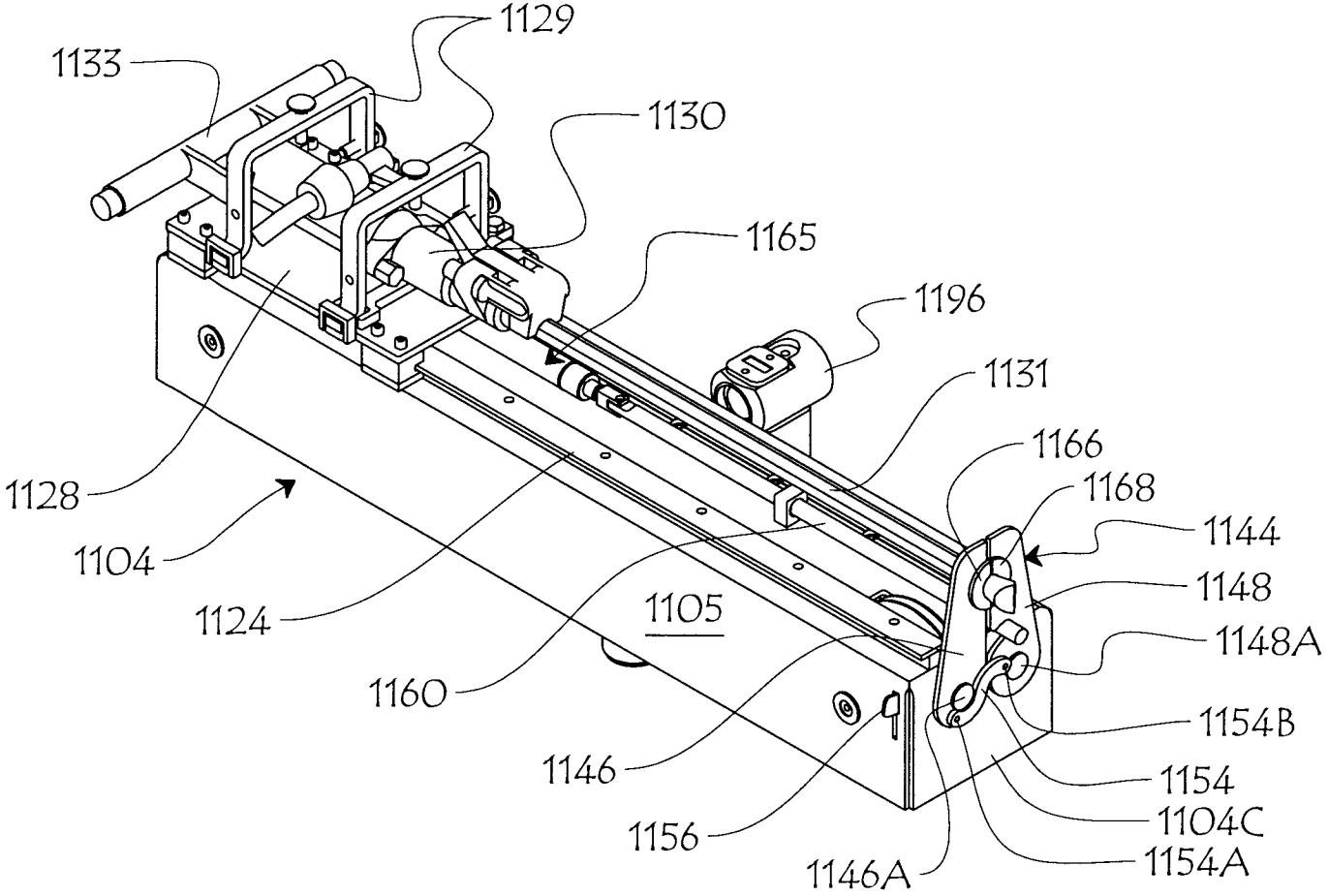
FIGS. 29 and 29A, and 30 and 30A, show perspective views of a second embodiment of turret and of associated drill head, sequentially suggesting how the drill head supporting carriage moves the drill head along the turret rail, and also suggesting how the drill bit leading edge portion projects beyond the turret and how the drill bit leading edge portion is axially guided by a pair of centering guide blades at the leading end edge of the turret.

In one embodiment shown in FIGS. 23, 24 and 28, the rails or runners 124, 126 are made from two elongated runner plates 402, 404, respectively, e.g. made from aluminum, bent to each form a V in cross-section for supporting the drill head carriage 128 slidingly forwardly and backwardly along turret 104. Elongated runner plates 402, 404, are interlocked in spaced apart fashion by a number (e.g. six as illustrated) of lengthwisely spaced planar T-shape brackets 610, lodged inside the V recess of runner plate 402, with bolt and nut assemblies 614 lockingly engaging bores 616, 618, respectively made in registering flange sections of runner plates 402, 404, wherein the overall rigidity of turret 104 is achieved. Two reinforced thicker T-shape brackets 612, of same size as bracket 610, are mounted at an intermediate lengthwise section of runner plate 402. Each bracket 610, 612, includes a large circular aperture 610A, 612A, made through its base leg for free through passage of pneumatic drive cylinder 330.

To each of the opposite ends of pneumatic cylinder 330, pulley system 302, 308 is mounted to turret 104. The two cables 450, 452, are fixed at one end to one and another underside sections of carriage 128, then engage pulleys 302, 308, and become fixedly connected to a piston inside cylinder 330. This piston moves lengthwisely inside pneumatic cylinder 330, under power from a pressurized air source. This way, the carriage 128 can be entrained toward either ends of the turret 104.

It is thus understood that the mining drill turret 104 integrally comprises a slider system allowing the drill head carriage to move linearly, a pneumatic cylinder 330 that will provide the thrust required for drill carriage displacement, and a structural construction from runner plates 402, 404 and brackets 610, 612 not unlinke that of an aircraft fuselage, that will provide a "rib structure" enabling accommodation of operational loads inherent to mine drilling as well as capable of enclosing the various turret components.

Each bracket 610, 612, further includes a notch 610B, 612B, on its transverse top leg head for passage of drive cable 450 (FIG. 24) or cable 452—operatively connected and operatively connected and entrained by the pneumatic drive cylinder 330 and being rolling supported by end pulleys 302, 308 (FIG. 25) carried at opposite ends of turret 104, wherein the runner plates are assembled as a rib structure.

As best shown in FIG. 24, in one embodiment, two sets of composite wear resistant plates 400 sized complementarily to carriage 128 are anchored by bolts 630 to the underside of drill head carriage 128, to reduce the friction on the top flange of runner plates 402, 404. The length of each wear plate 400 could be for example about 15 centimeters. Composite wear resistant plates 400 are also adjustable to extend useful lifetime thereof. Plates 400 on each side of the drill head carriage 128 reduce the friction on the runner plates 402, 404.

It is noted that components 128, 130, and 400 become integral to one another, and slidingly move over the joined pair of runner plates 402, 404. Runner plates 402, 404, form the general stationary frame of turret 104.

The drill carriage 128 may also have an adjustment system 410 (FIG. 24) for cable tensioning of cables 452, 450.

Wear resistant plate 401 may line the top flange of folded aluminum runner plates 402, 404, to protect them and prevent premature wear thereof. Plate 401 may be made e.g. from folded stainless steel.

It is noted that the handles 142 or 142', are attached to one of the two sides of the runners 124, 126, depending on the turret lengthwise drilling position, thus allowing to maneuver and to orient the turret 104 in the safest and most ergonomic way as possible.

As best seen in FIGS. 29 to 36, there is provided a second embodiment of turret 1104. A 1000-series reference numerals set will apply to the second embodiment of turret. Turret 1104 includes a releasable drill bit centering assembly 1144, provided over rails 1124, 1126, spacedly proximate turret end edge 1104C. Centering assembly 1144 includes two blade arms 1146, 1148, pivoted at one end 1146A, 1148A, to rails 1124, 1126, respectively, and releasably abuttable against one another at their opposite end portions 1146B, 1148B. Each centering arm end portion 1146B, 1148B includes a notch 1150, 1152, respectively complementary to one another which when abutting against one another form a cylindrical channel 1150, 1152 (FIG. 29C), sized and shaped for free sliding passage of drill bit 1131.

In the second embodiment of turret of FIGS. 29 to 36, the pivotal inner end portions of drill bit centering arms 1146A, 1148A, are pivotally interconnected by an S-shape interlink rod 1154, at pivot mounts 1154A, 1154B being parallel to but slightly offset relative to pivot mounts 1146A, 1148A, in such a fashion that scissor type movement of arms 1146, 1148 is achieved, i.e. when arm 1146 moves away from arm 1148, arm 1148 will concurrently pivotally move away due to the offset interlink rod 1154. A manual lever 1156 projecting transversely outwardly from the main body 1105 of turret 1104 is operatively connected at pivot axle 1146A, all in such a way that in a raised condition of lever 1156, the top ends of arms 1146A, 1148A, are closed against one another (FIGS. 29, 29A, 29B, 29C), and cylindrical channel 1150, 1152 is formed (FIG. 29C), whereas when lever 1156 is manually brought down to a lowered condition (FIGS. 30, 30A), the top ends of arms 1146B, 1148B, are spread apart. In an alternate embodiment, the motion of lever 1156 is remotely power controlled (not shown).

Figure 30A:
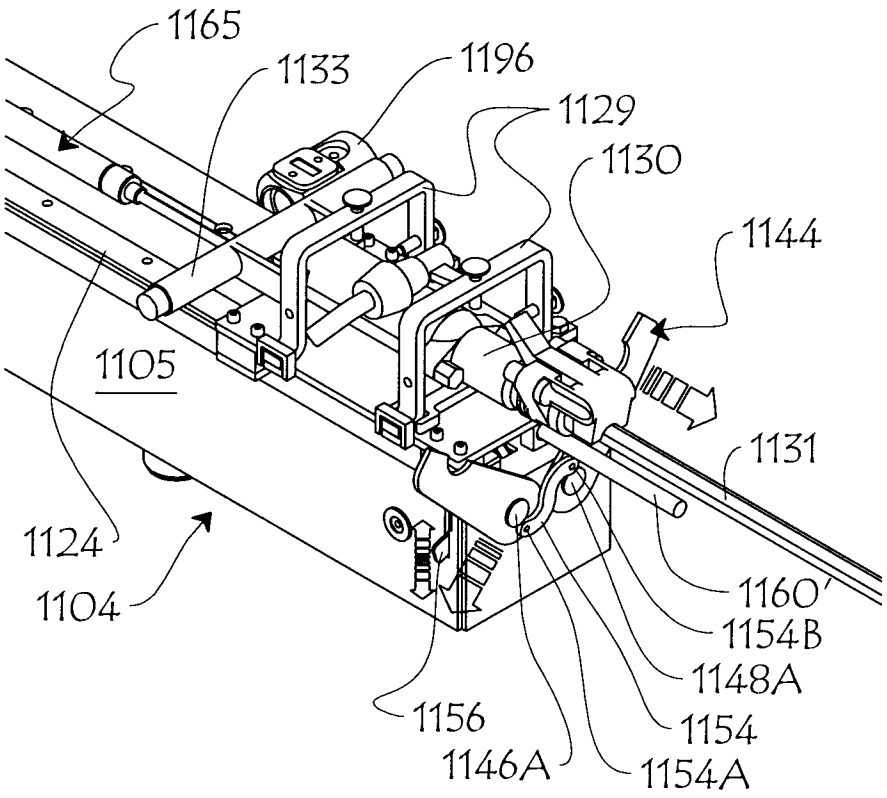
Figure 29A:
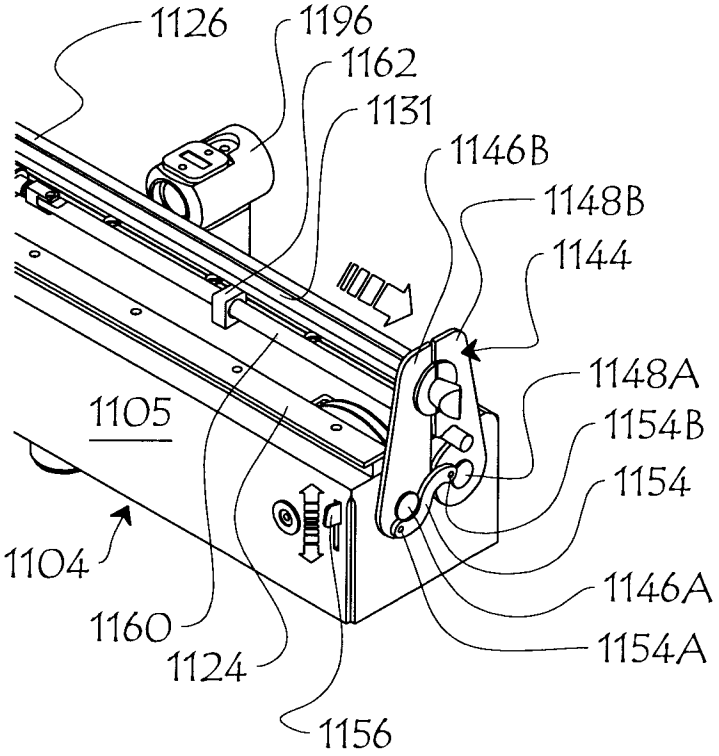
Figure 29C:
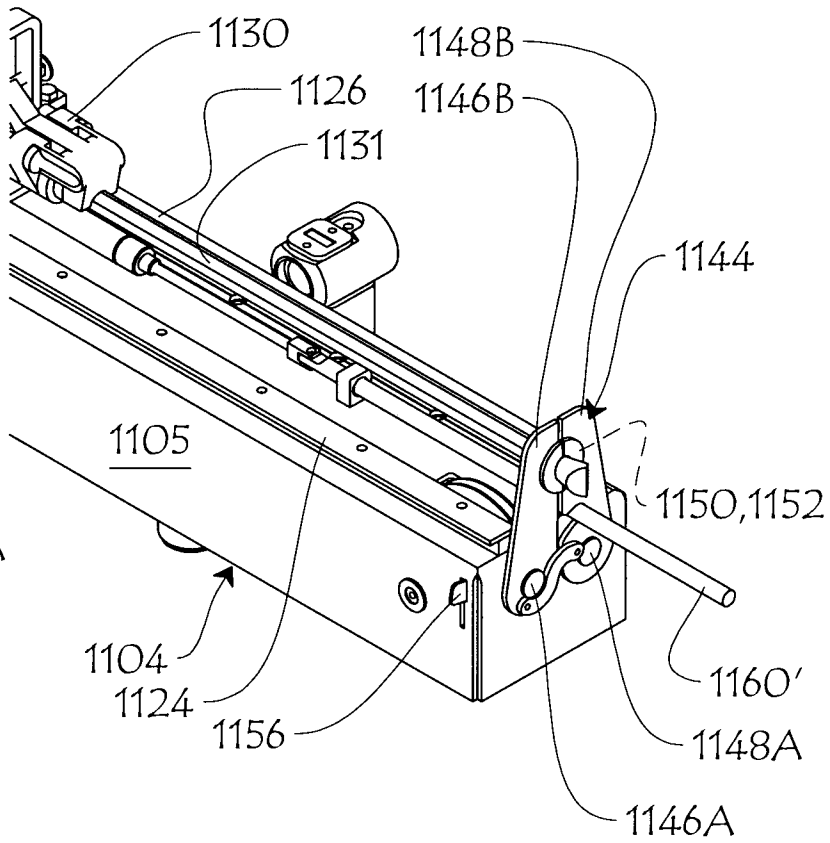
Figure 29B:
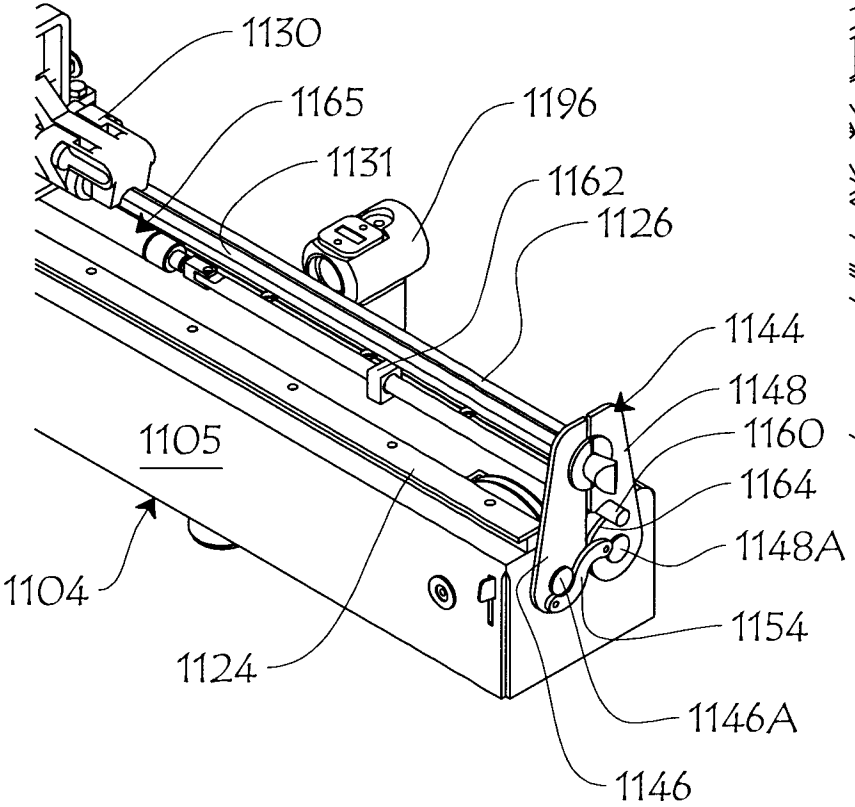
Figure 30:
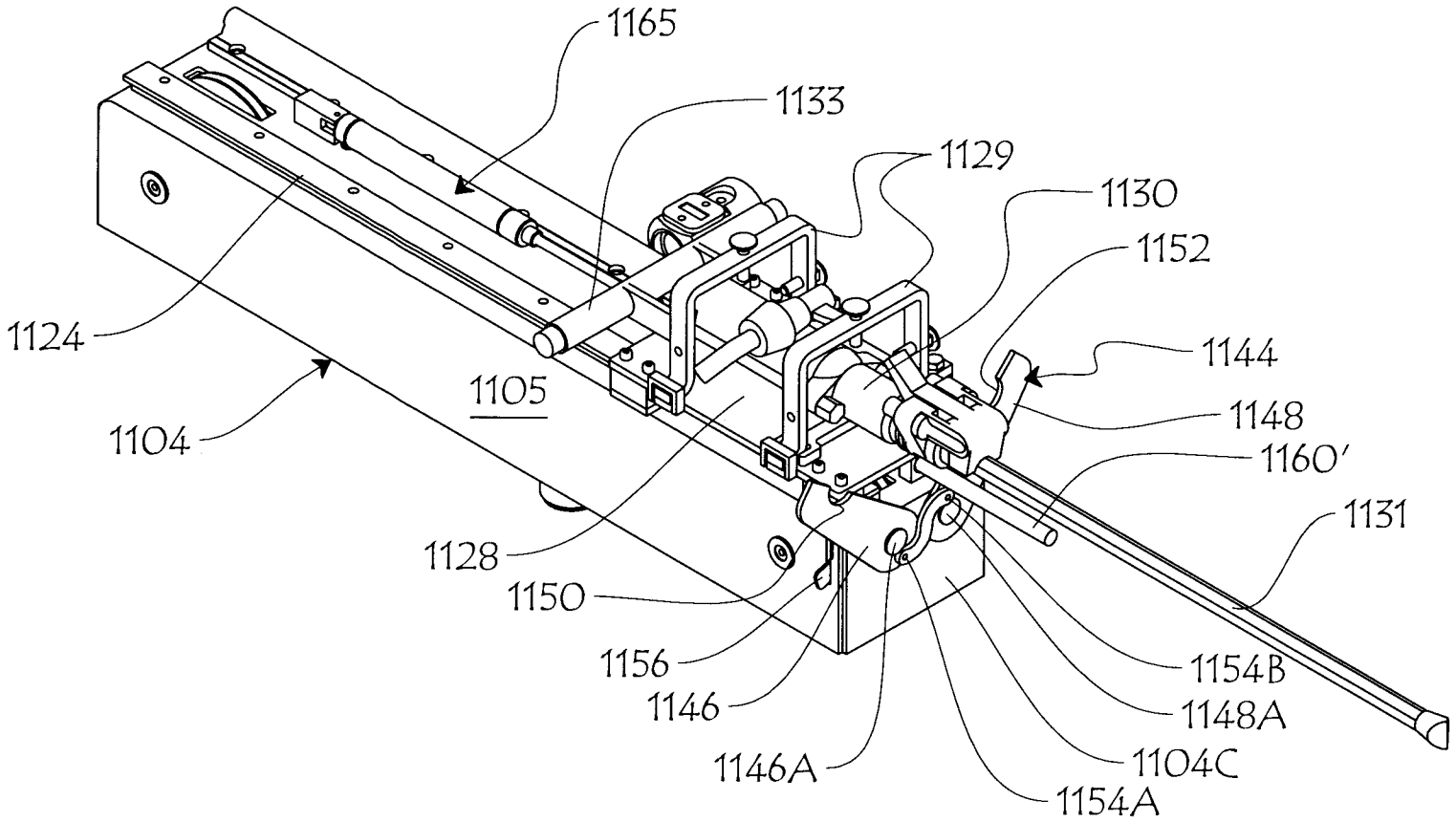
Figure 31:
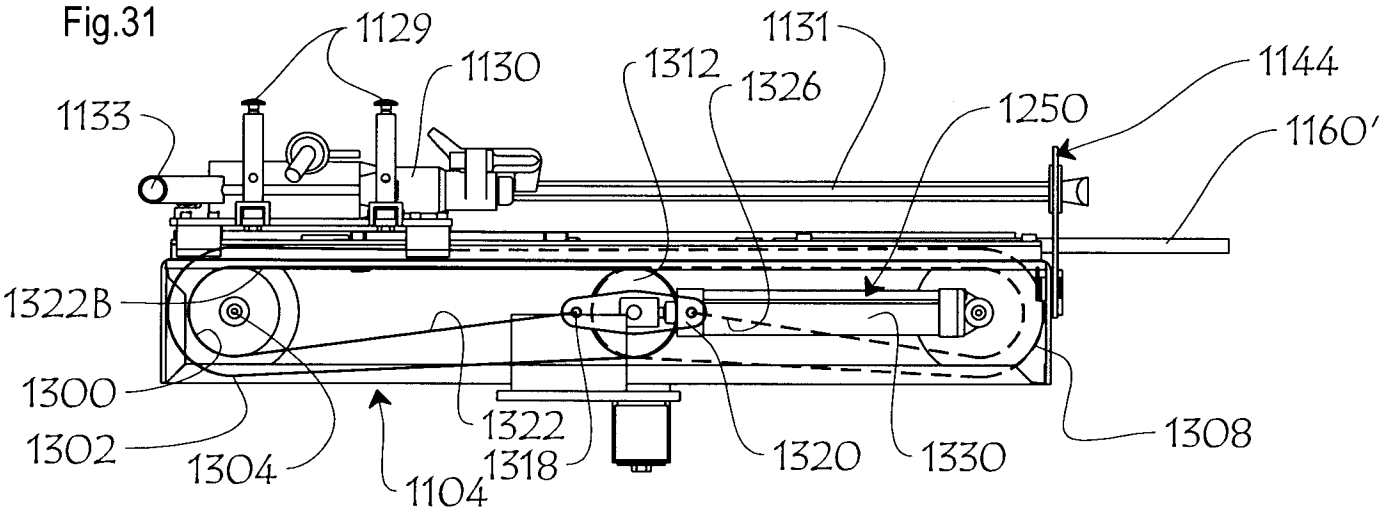
FIGS. 31 and 32 are partly schematic longitudinal sectional views of the turret of FIG. 29 and associated drill head, sequentially suggesting how the cable and pulley system provides thrust to the drill carriage over the turret rail.
Figure 32:
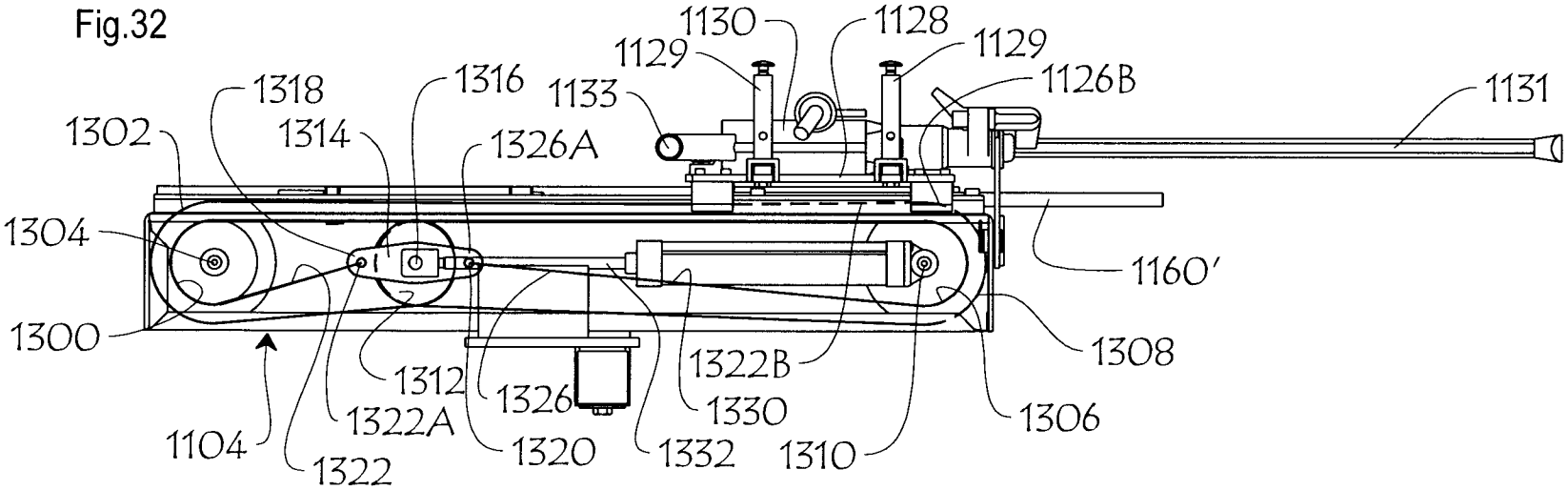
Figure 33:
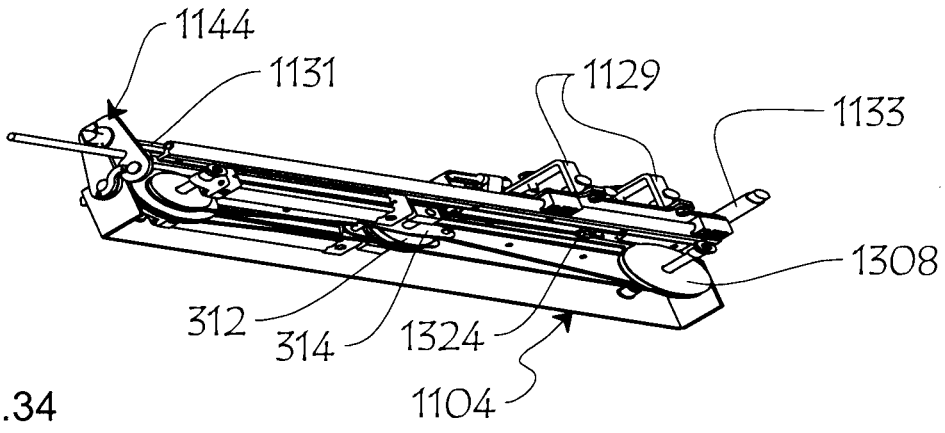
FIGS. 33, 34 and 35 are views similar to FIGS. 31 and 32 but showing the second embodiment of turret and at a smaller scale and from the opposite lateral side of the turret and being more schematic, and sequentially suggesting operation of the cables, trolley and pulleys drive system for the drill head carriage.
Figure 34:
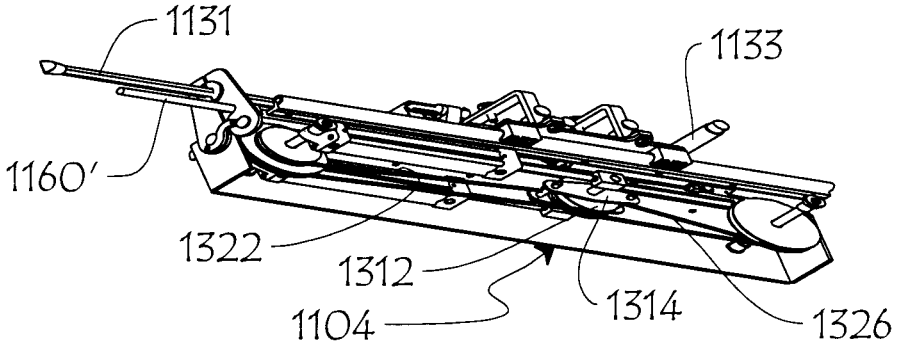
Figure 35:
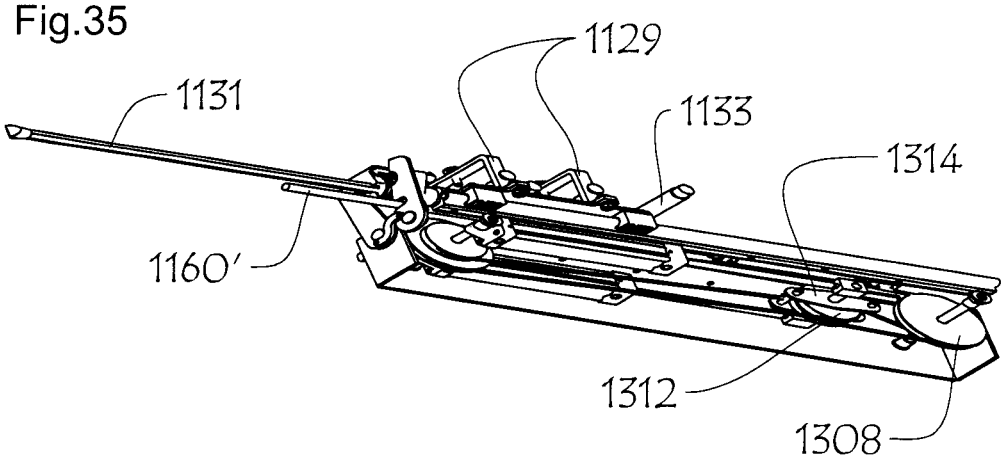
Figure 36:
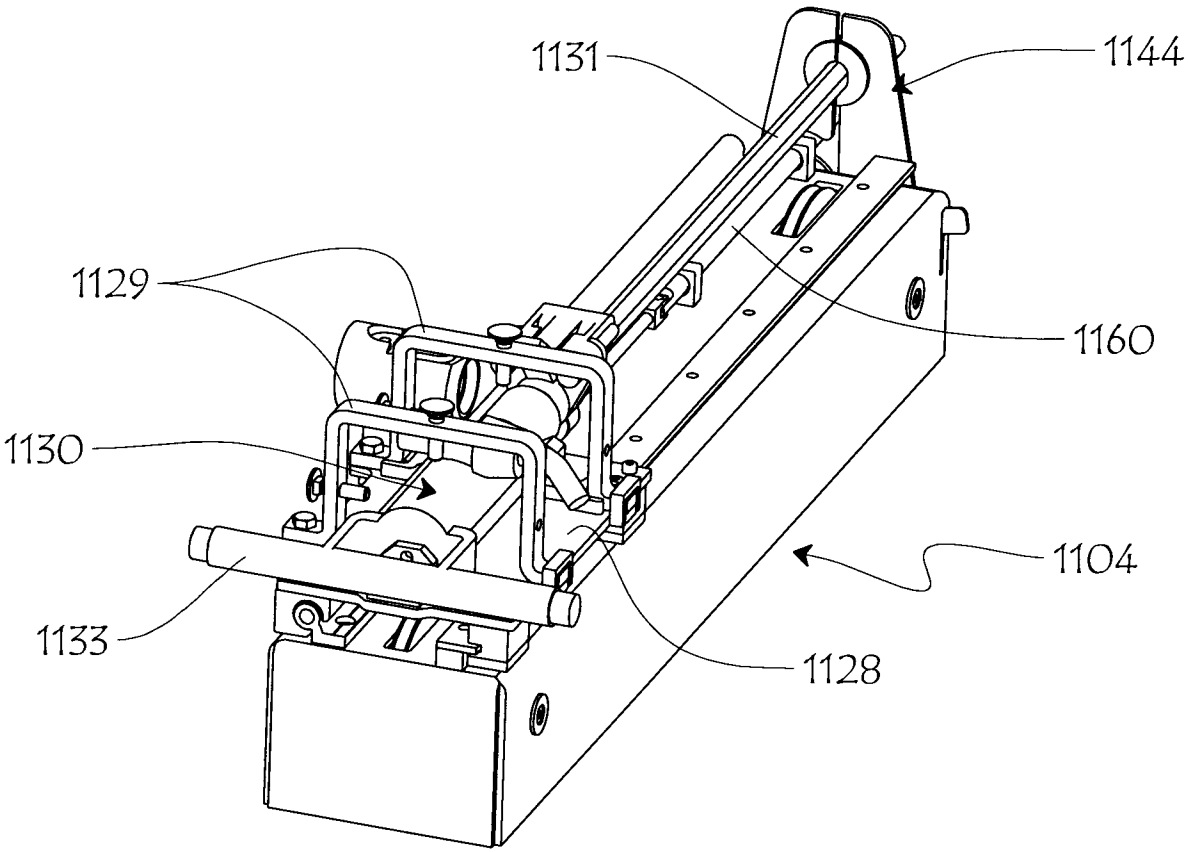
FIG. 36 is a view similar to FIG. 29, but from another perspective.

Also, as suggested sequentially in the embodiment of FIGS. 29A, 30A, and also FIGS. 29B, 29C, a rock wall stabilizing stinger rod 1160 is slidingly carried over turret 1104 by guide brackets 1162, and also slidingly supported by a registering notch 1164 made in one centering arm 1148 which comes in register therewith when centering arms 1146, 1148, are closed (FIGS. 29, 29A, 29B, 29C). A pneumatic axial drive system 1166 (anchored at its outer end to turret main body 1105) is provided at its inner end with stinger push rod 1160 to push the latter through and beyond the drill centering assembly 1144 from a retracted condition 1160 to an extended condition 1160', for stabilizing engagement with the rock wall to be drilled.

In one embodiment, indexer sockets 1166, 1168, (FIG. 29) are further provided about centering arms notches 1150, 1152, for slight extension of drill bit threshold support by centering arms assembly 1144.

The drill head drive system 1250 of the second embodiment of turret 1104 is best illustrated in FIGS. 31-35. In the hollow of the main elongated body 1105 of turret 1104, at one end thereof a first diametrally smaller pulley 1300 and a second diametrally larger pulley 1302 are both coaxially journaled at a fixed same horizontal transverse pivotal mount 1304. Similarly, a pair of diametrally smaller and larger pulleys 1306, 1308, respectively (inverted relative to pulleys 1300, 1302) are both coaxially pivotally journaled at a same fixed horizontal pivot mount 1310 of turret main body 1105 opposite pivot mount 1304. A pair of separate floating side by side pulleys 1312, 1312, are movably mounted between opposite ends pulleys 1300, 1302, and 1306, 1308, respectively. A trolley 1314 is freely pivotally mounted to the two intermediate pulleys 1312, 1312, about a horizontal transverse pivot mount 1316 parallel to pivot mounts 1304 and 1310. Pivot mount 1316 does not engage turret body 1105. Trolley 1316 defines two opposite ears 1318, 1320.

A first cable 1322 is fixed at one end 1322A to trolley ear 1318, pass around diametrally smaller pulley 1300, then comes back around one intermediate pulley 1312, and then cable 1322 comes back around diametrally larger pulley 1302 beside pulley 1300; the end 1322B of cable 1322 opposite cable end 1322A is anchored to the underside of drill head carriage 1128 at anchor point 1324. A similar arrangement is achieved with a second cable 1326 anchored at one end 1326A to trolley ear 1320, passing around diametrally smaller pulley 1306, then back to the other intermediate pulley 1312, then back to diametrally larger pulley 1308, with the cable end 1326B opposite cable end 1326A being anchored also at the same anchor point 1324 at the underside of drill head carriage 1128 than the other cable end 1322B. Pneumatic cylinder 1330 is pivotally carried at one end at pulley axis 1310, and the piston rod head 1332 of cylinder 1330 is pivotally carried at intermediate pulley axis 1316.

Pulleys 1300, 1302, 1306, 1308, are located at both ends of the runners 1124, 1126. They ensure the transmission of travel induced by the piston 1332 of the double acting pneumatic cylinder 1330 to the drill head carriage 1128 by steel cables 1322, 1326. In one embodiment, the pulleys 1300, 1302, 1306, 1308, are lined by sheathing to protect the cables 1322, 1326. The pneumatic cylinder is an important component of the present invention.

In this way, a reduction ratio is achieved between the drill head carriage travel and the piston stroke of cylinder 1330. In one embodiment, this reduction ratio has a value of 3 to 1, wherein pneumatic cylinder 1330 is correspondingly oversized to compensate torque overload.

It can now be understood that an alternative to brake means 188, 200, 212, 214, from the first embodiment of turret 104, consists of one or more of the feeler fingers 1160 (FIGS. 29 to 36) form the second embodiment of turret 1104 activated before the work with the drill 1130. Secured to the turret 1104, the outer leading end of the feeler fingers 1160 rest firmly against the rock wall, preventing any accidental load-borne pivoting action of turret 1104. There is thus a rod spear feeler finger 1160 having one end which receives a surface engaging tip which inter-engages with the rock wall, the other end thereof being connected to pneumatic cylinder 1165 anchored to turret main body 1105. Thus once the operator has oriented the turret 1104 in the right direction it actuates a switch on the control box 1134 which has the effect of supplying the compressed air to cylinder 1165, thus rod 1160 will move toward the rock wall and apply a load against same so as to anchor by friction the end of the turret 1104 to the rock wall 1104, thus providing inter-locking. Once completed, the operator activates via the control box 1134 the release of the cylinder feeler finger rod 1160 which releases the turret 1104 which can then rotate once again around the two L-shape frame pivot mounts 1196, 1198.

In one embodiment, the outer end engaging tip of each feeler fingers 1160 carries a rubber cap, but other embodiments can be used depending on the work and the type of the rock wall. The ingenuity here is getting past the axis of the feeler finger 1160 through the turret center of gravity, i.e. the center of rotation (they are at the same place), so as not to create pivoting loads when the stinger 1160 grips on the wall to be drilled. Thus the orientation chosen by the worker is maintained both during the initial positioning and during loading.

The present drill carriage drive system (FIGS. 31-32) of the second embodiment of turret 1104 consists of an assembly of pulleys, trolley and cables that provide reduction ratio of the displacement action of the drill head carriage 1128 relative to the piston extension of pneumatic cylinder 1330. The goal is to use standard pneumatic technology, which is reliable, efficient and cost-effective, to generate large amplitude or even maximum drill head carriage displacement, relative to a minimal length of the total length of the sliding carriage 1128. That is to say, in the present invention, procuring a given length ratio between drilling capability and overall turret length being as close as possible to the 1 to 1 ratio. The present cable drive system is also bidirectional: in one direction corresponding to the cylinder piston extension, the drill head carriage 1128 moves toward the rock area to be drilled while the upstream cable 1326 (closer to the rock area to be drilled) comes into pull mode while the downstream cable 1322 (opposite the upstream cable) becomes in slave mode; while in the other direction, the opposite occurs, i.e. the downstream cable 1322 becomes in pulling mode while the upstream cable 1326 becomes in slave mode.

Thus, in one embodiment, since we have three loops of the downstream cable 1322 on the carriage 1128, when the latter moves by 2.5 centimeters (cm) on the right hand side under action from the pneumatic cylinder 1330, then, a corresponding 7.5 cm of downstream cable 1322 is required to make up for this 2.5 cm of displacement. That is where the 3 to 1 reduction ratio of movement comes from, which allows us greater level of compactness for the power drive system compared to the travel distance of carriage 1128. As a consequence, the pulling force generated by the cylinder 1330 is reduced by three, but this can be compensated by increasing the size of the cylinders.

For clarity of the view, the cables 1322, 1326, are shown in the figures as being fixedly mounted to the same area of the drill carriage 1128, however, to improve upon compactness, the cables may be fixedly mounted to the end opposite their displacement direction. In other words, the cables 1322, 1326, intersect under the mobile carriage. Moreover, a cable tensioning system may also be provided to create pre-tensioning prior to installation.

In the second embodiment of turret 1104, guiding sockets 1166, 1168 are provided for supporting the drilling bit 1131. These sockets are split and secured onto the outer end portions 1146B, 1148B, of the two centralizer support blades 1146, 1148. These two support blades 1146, 1148 are mounted to the upstream end of the turret main body 1105 with the blades 1146, 1148, providing relative scissor like movement via synchronizing system 1154. The goal of this scissor-like opening movement of the support blades 1146, 1148 is to enable the drill head 1130 to extend beyond the turret end edge 1104C (FIG. 30) during the sliding movement of carriage 1128 over the rails 1124, 1126, and thus allow for several additional centimeters of drilling travel when it is required. This system also enables optimization of the total drilling capability relative to the overall size of the turret 1104.

The indexer 1144 of the second embodiment of turret 1104 opens and closes responsively to actuation of a manual lever 1156 upwardly (closed) or downwardly (open). This actuation lever 1156 is fixedly mounted to the left hand side blade 1146 on FIGS. 29A, 29B. By actuating manually this lever 1156 upwardly or downwardly, the left hand side blade 1146 will pivot about the turret lengthwise axis, which concurrently brings pivotal action of S-shape synchronizing lever 1154 interconnecting both blades 1146, 1148, which generates pivotal of the right hand slide blade 1148 in the opposite direction thus inducing scissor like opening and closure thereof. In one embodiment, a retainer hook in the turret main body 1105 allows the releasable anchoring of this actuation lever 1156 in its upward position corresponding to the closed indexer condition, against accidental opening of blades 1146, 1148.

In operation, the drilling machine, such as 130 in the first embodiment of turret or 1130 in the second embodiment of turret, is controlled through valves (ball valves and directional valve) located on the articulated boom 108, 110 above the horizontal arm 110. As shown in FIG. 1, a first valve 500 identified by DRILL AIR controls the air supply to the drill itself and activates the rotation of drill bit 131. A second valve 502 identified by DRILL CARRIAGE allows the slider carriage 128 to move forward on the rails 124, 126, parallel to the insertion of the drill bit 131 into the rock wall. In one embodiment, there is provided water supply into the drill bit to clear debris from the cavity and avoid overheating of the drill bit. The water supply is controlled through a third valve 504 identified by DRILLING WATER. An advantage of the use of valves of the type "ball valve and directional" is that they allow us to modulate the effect of each of them. It is therefore possible to adjust independently the water supply, the speed of rotation of the bit and the travel speed of the carriage 128 as required, independently of one another.

The gist of the invention is thus to assist the operator for all tasks. First with the "joystick" of control box 134 and/or by pressing the switch that unlocks the pivotal action of the boom 102. The operator positions the drill head 130 to the desired location, this operation controls the deployment of two articulated arms 110, 108, and then the operator releases the brake and then manually orients the drill head 130, in an effortless way since its weight is neutralized, in the suitable orientation and locks at the selected angle while activating the brake means 188, 200, 212, 214 of the first embodiment of turret 104 (or the feeler fingers 1160 of the second embodiment of turret 1104) by pressing the corresponding switch of the control box 134. Then, using the controls (valves) on the horizontal arm 110, the operator engages in the various drilling and bolting operations.

The operational requirements may vary from field to field, so when performing drilling in order to set anchors to release hydrostatic pressure or to conduct seismic retro-rehabilitation. To name a few, the prerequisites are very different from mining environment.

For example, it is rarely useful to drill very deeply, often the overall machine bulk is a problem, and it is necessary to optimize the air consumption.

In the second embodiment of turret 1104 shown in FIGS. 29 to 36, the drill is shorter relative to total travel path, because it uses a different travel principle. In one embodiment, the action of conventional pneumatic cylinders is provided with a reduction ratio to produce the forward travel of the carriage 128 in order to make the system as compact as possible.

The centralizer 144 of drill bit 131 can be cleared with power in the first embodiment of turret 104, or manually as 1144 for drill bit 1131 in the second embodiment of turret 1104, to more effectively use the full stroke of the sliding carriage 128, and thus to extend the depth of drilling.

For reasons of weight control, in one embodiment, the rails 124, 126, consist almost exclusively of aluminum.

With respect to the holder type and installation, the invention may be used in configurations different from the mobile platform of FIG. 1A, e.g. fixedly bolted to the floor of a scissor lift, of a platform or of a lori (rail platform).

It is noted that whenever suitable for the person skilled in the art, one or more components form the first embodiment of turret 104, e.g. the centering system 144, could be replaced by corresponding components from the second embodiment of turret 1104 (e.g. the centering system 1144), this being considered within the scope of the present invention.

In one embodiment, the invention is equipped with an independent power unit 132 supplied with compressed air only. Indeed, compressed air is generally available in abundance on construction sites and mines: it is very interesting to use it as the sole source of energy, to manipulate it and transform same to provide hydro, pneumatic and electrical energy needed. This total assembly also has the advantage of not emitting toxic fumes, which are particularly problematic especially in enclosed areas such as garages or in underground mine shafts.

The system can also handle the compressed air supplied to the tools, that is to say to filter and lubricate same to enhance the operation thereof and extend useful lifetime of the control and tool components.

The invention claimed is:

1. A manually operated drill positioner, comprising:

an articulated boom having one end for releasable coupling to a platform and another end opposite said one end;

a drill turret assembly for receiving a drill, comprising:

a drill turret defining a main body with an exposed outer wall and, an inner wall opposite said outer wall, and first and second opposite ends, a lengthwise rail member mounted to said outer wall;

a carriage slidingly engaging said rail member and operable to slidingly carry a drill head over said exposed outer wall for reciprocating motion between said first end and second ends of the drill turret;

a drive for power actuating said carriage sliding motion along said rail member;

a joint assembly releasably anchored to said another end of the boom and having a frame sized and shaped for releasable engagement with an intermediate section of said main body of the drill turret between the first and second ends thereof, the joint assembly comprising:

a first coupling pivotably connected to the main body of said drill turret for pivotal movement of said drill turret about a first axis; and a second coupling pivotably connected to said another end of the boom for tilting movement of said drill turret about said another end of the boom along a second axis transverse to said first axis;

wherein, prior to a drill operation, an intersection of the first axis and the second axis coincides with a center of gravity of the drill turret assembly to provide a manual and human manipulation of the drill turret assembly.

2. A drill positioner as in claim 1, further including a releasable brake member, releasably locking said drill turret at a selected pivoted and tilted orientation.

3. A drill positioner as in claim 2, wherein said frame comprises an L-shape frame having a first leg and a second leg, said first leg defining an outer end provided with a first sleeve defining the first axis, said second leg defining an outer end provided with a second sleeve defining the second axis, the first axis being orthogonal to said second axis, said second coupling including a second pivot mount member pivotally engaging said second sleeve and releasably coupling with said another end of the boom, said first coupling including a first pivot mount member pivotally engaging said first sleeve and releasably coupling with said inner wall of the drill turret.

4. A drill positioner as in claim 2, further including a drill bit guide member, disposed at said first end of said main body for centering axial reciprocating displacement of a drill bit from the drill head carried by said carriage.

5. A drill positioner as in claim 4, wherein said guide member consists of a scissor-like blade assembly defining first and second elongated blades each having an inner end pivotally connected at said first end of said main body, and an outer end, each outer end movable away from the other outer end in an opened condition and toward the other outer end in a closed condition, recesses formed at said outer ends and complementarily shaped to receive therethrough the drill bit in the closed condition.

6. A drill positioner as in claim 5, wherein each blades further includes another recess formed intermediate said inner end and outer ends, the drill positioner further including a spear stinger having a main body and a leading end portion slidingly movable between a first position, where said leading end portion is disposed within said another recesses, and a second position where said leading edge portion extends beyond said another recess, wherein said spear stinger extends for providing stabilizing engagement with a surface wall during drill operation.

7. A drill positioner as in claim 2, wherein said main body of the drill turret is hollow, and wherein said drive includes a pneumatic ram coupled to intersecting cables in a cables, trolley and pulleys system lodged within said main body and providing a reduction ratio for the pneumatic ram.

8. A drill positioner as in claim 2, wherein said drill turret is displaceable relative to said articulated boom between a first operative position where said drill turret is orthogonal to said boom, and a second storage position where said drill turret is closely spaced parallel to said boom.

9. A manually operated drill positioner and a drill in combination, the combination comprising:

an articulated boom having one end for releasable coupling to a platform and another end opposite said one end;

a drill turret assembly, comprising:

a drill turret defining a main body with an exposed outer wall and an inner wall opposite said outer wall, and first and second opposite ends, a lengthwise rail member mounted to said outer wall;

a carriage slidingly engaging said rail member;

a drill head mounted to said carriage and movable therewith over said exposed outer wall in reciprocating motion between said first and second ends, a drill bit projecting from said drill head;

a drive power actuating said carriage sliding motion along said rail member;

a drill power unit operatively connected to said drill head and mountable to the platform;

a joint assembly releasably anchored to said another end of the boom and having a frame sized and shaped for releasable engagement with an intermediate section of said main body of the drill turret between the first and second ends thereof, the joint assembly comprising;

a first pivotal coupling pivotally interconnecting the main body of said drill turret to said frame along a first axis; and a second pivotal coupling pivotally connecting to said another end of the boom for tilting movement of said drill turret about said another end of the boom along a second axis transverse to said first axis;

wherein, prior to a drill operation, an intersection of the first axis and the second axis coincides with a center of gravity of the drill turret assembly to provide a manual and human manipulation of the drill turret assembly.

10. A drill and positioner combination as in claim 9, further including a releasable brake member, releasably locking said drill turret at a selected pivoted and tilted orientation.

11. A drill and positioner combination as in claim 10, wherein said frame comprises an L-shape frame having a first leg and a second leg, said first leg defining an outer end provided with a first sleeve defining the first axis, said second leg defining an outer end provided with a second sleeve defining the second axis, the first axis being orthogonal to said second axis, said second coupling including a second pivot mount member pivotally engaging said second sleeve and releasably coupling with said another end of the boom, said first coupling including a first pivot mount member pivotally engaging said first sleeve and releasably coupling with said inner wall of the drill turret.

12. A drill and positioner combination as in claim 10, further including a drill bit guide member, disposed at said first end of said main body, and providing centering axial reciprocating displacement of said drill bit from the drill head mounted to said carriage.

13. A drill and positioner combination as in claim 12, wherein said guide member consists of a scissor-like blade assembly defining first and second elongated blades each having an inner end pivotally carried by said first end, and an outer end movable away from each other in an opened condition and toward each other in a closed condition, recesses formed inwardly at said blades outer ends and defining jaws complementarily shaped for free slide through engagement therebetween of the drill bit in their said closed condition.

14. A drill and positioner combination as in claim 9, wherein said main body is hollow, and wherein said drive includes a pneumatic ram coupled to intersecting cables in a cables, trolley and pulleys system lodged within said main body and providing a reduction ratio for the pneumatic ram.

15. A drill positioner as in claim 1, wherein the drive includes separate cable sections, each cable section having a first end coupled to a pneumatic piston and a second end coupled to the carriage, each cable section being wound about a pulley disposed at one of the first and second ends of the main body of the drill turret.

16. A drill positioner as in claim 1, wherein the rail member includes two elongated runner plate each having a V-shaped cross-section, the runner plates being interlocked and spaced from one another to support the carriage slidingly mounted thereon.

17. A drill positioner as in claim 16, further including two sets of composite wear resistant plates sized complementarily to said carriage and anchored by anchoring elements to the underside of said carriage, said wear resistant plates shielding a top flange of the runner plates to reduce the friction thereon.

18. A drill positioner as in claim 16, wherein the runner plates are interlocked in spaced apart fashion by a number of lengthwisely spaced planar T-shape brackets, lodged inside the V recess of a first runner plate, with anchoring assemblies lockingly engaging bores respectively made in registering flange sections defined by said runner plates, each of said brackets defining a base leg and a transverse top leg, a large circular aperture made through said bracket base leg, each of said brackets further including a notch on its top leg for passage of a pair of drive cables operatively connected at one end to and entrained by the drive and rollingly supported by end pulleys carried at opposite ends of said drive turret and connected at the opposite end to said carriage, wherein said runner plates are assembled as a rib structure.

19. A drill positioner as in claim 4, wherein the drill bit guide member includes two arms each having a notch, the arms being moveable relative to one another between an open position and a guiding position, the arms in the open position being spread apart and generally parallel to one another, the arms in the guiding position being substantially coplanar and the notches forming a channel sized and shaped for free reciprocating displacement of the drill bit.

20. A drill and positioner combination as in claim 9, further including two sets of composite wear resistant plates sized complementarily to said carriage and anchored by anchoring elements to the underside of said carriage, said wear resistant plates shielding a top portion of the rail member to reduce the friction thereon.

* * * * *